US005181714A

United States Patent [19]

Yamagishi et al.

[11] Patent Number: 5,181,714

[45] Date of Patent: Jan. 26, 1993

[54] DOCUMENT FEEDER WITH ADJUSTABLE LENGTH DOCUMENT REVERSING TRANSPORT PATH

[75] Inventors: Toshio Yamagishi, Nara; Youichi Kimura, Nabari; Tamotsu Shuto, Kashihara; Tatuya Ito, Yamatokoriyama, all of Japan

[73] Assignee: Sharp Kabushiki Kaisha, Osaka, Japan

[21] Appl. No.: 796,351

[22] Filed: Nov. 22, 1991

[30] Foreign Application Priority Data

Nov. 26, 1990 [JP] Japan ..... 2-321711
Mar. 25, 1991 [JP] Japan ..... 3-060199
Jul. 8, 1991 [JP] Japan ..... 3-167176

[51] Int. Cl.[5] ..... B65H 29/00

[52] U.S. Cl. ..... 271/186; 271/291; 271/902

[58] Field of Search ..... 271/3.1, 186, 291, 301, 271/902, 3, 225

[56] References Cited

U.S. PATENT DOCUMENTS 3,770,348 11/1973 Martin ..... 271/301
4,065,119 12/1977 Schroter .
4,072,305 2/1978 Scheid et al. ..... 271/301
4,445,682 5/1984 Uchida ..... 271/301
4,456,237 6/1984 Buddendeck ..... 271/291
4,465,271 8/1984 Saitoh et al. ..... 271/301
4,469,319 9/1984 Robb et al. ..... 271/3.1
4,815,722 3/1989 Sugimoto ..... 271/291
4,842,262 6/1989 Carrish .
4,921,239 5/1990 Okui et al. ..... 271/291
4,923,190 5/1990 Hirose ..... 271/291
4,932,798 6/1990 Kardinal et al. .
5,027,162 6/1991 Kida et al. ..... 271/291
5,031,003 7/1991 Hamano ..... 271/301

FOREIGN PATENT DOCUMENTS 0263058 4/1988 European Pat. Off. .
0292001 11/1988 European Pat. Off. .
59-208538 11/1984 Japan .
60-019638 1/1985 Japan .
61-124467 6/1986 Japan .
61-226425 10/1986 Japan .
2-76759 11/1990 Japan ..... 271/301
2099796 12/1982 United Kingdom .

*Primary Examiner*—Joseph E. Valenza
*Assistant Examiner*—Steven M. Reiss

[57] ABSTRACT

A document feeding device for feeding documents to a document scanning section where the image of the document is scanned. The document feeding device has first trasnport rollers for feeding each document to the scanning section, discharge rollers for discharging from the scanning section the document thus supplied, a reversing transport path for passing and turning over the document sent from the discharge rollers, and second transport rollers for feeding the document that has been turned over through the reversing transport path to the document reading section. The reversing transport path is designed to change the length of the document transport path depending on the size of the document. With the arrangement, reversing operation and scanning operation of the documents can be performed effectively. Further, without increasing the momentary transporting speed of the document transport mechanism, this arrangement makes it possible to feed documents at comparatively high speed from an entire apparatus standpoint.

5 Claims, 26 Drawing Sheets

DOCUMENT FEEDER WITH ADJUSTABLE LENGTH DOCUMENT REVERSING TRANSPORT PATH

FIELD OF THE INVENTION

The present invention relates to a document feeder for use in copying machines, scanners, facsimiles or other apparatuses, which automatically feeds documents to a document scanning section of the main body of those apparatuses.

BACKGROUND OF THE INVENTION

A document feeder 92 as shown in FIG. 20 is provided on the top portion of the main body of, for example, a copying machine 98 which is capable of copying two sides of a sheet of paper. In this document feeder 92, as shown in FIGS. 21 and 22, a document E placed on a document tray 95 is transported toward a reversing roller 96 by a plurality of transport rollers 93 and a conveyer belt 94. As shown in FIGS. 23 through 25, the document E which has been turned over by the reversing roller 96, is then placed by the rotation of the conveyer belt 94 at a predetermined position on a glass plate 99 shown in FIG. 26. In this position, the document E is subjected to scanning through the glass plate 99 by light projected from a light source, not shown.

Next, the document E having been subjected to the scanning light as described above, is turned over again by the reversing roller 96 as shown in FIG. 27, and then, as shown in FIGS. 28 and 29, is placed by the rotation of the conveyer belt 94 to the predetermined position on the glass plate 99 shown in FIG. 30. At this time, the side of the document E to be scanned is reversed to that of the former position shown in FIG. 26.

Then, placed in this position shown in FIG. 30, the document E is again subjected to scanning by light projected from the light source, not shown. Thereafter, as shown in FIG. 32, the document E is discharged onto a document discharge tray 97 located above the conveyer belt 94 by the reversing operation of the reversing roller 96 as illustrated by FIG. 31, and as such a two-sided copying operation is completed.

Recently, there have been demands on those image processing apparatuses, such as copying machines, toward high-speed image processing. In order to achieve high-speed image processing, the document feeder is also required to provide high-speed handling of the documents.

However, in the conventional document feeder 92, the two-sided copying operation is conducted through a complicated sequence of processes with respect to the document E, such as: feeding→transporting→reversing→backward transporting→copying (one side)→reversing→backward transporting copying (the other side)→discharging. Thus, after placing the document E on the document tray 95, many processes including two reversing operations are necessary to complete the two-sided copying operation. Further, when the document E is to be scanned by light, it should be stopped exactly at the predetermined position on the glass plate 99.

Furthermore, in the conventional document feeder, the length of the document transport path and the timing of document feeding are designed to be suitable only for the largest size of the documents that the copying machine can handle. Consequently, in the case of feeding smaller-size documents, the time interval between the feeding operations and the length of the document transport path become longer than required.

This results in a drawback in which the average processing speed per document in the two-sided copying operation becomes considerably low.

Therefore, in order to increase the average processing speed of the document feeder with a view to achieving high-speed image processing in copying machines or other apparatuses, the momentary transporting speed of the document feeding mechanism including the conveyer belt 94 and reversing roller 96 should be increased, that is, the speed of the document feeding mechanism during operation should be increased.

However, the faster the momentary transporting speed of the document feeding mechanism becomes, the more damage the document suffers when a paper jam occurs. Further, as the momentary transporting speed is increased, more problems are caused in that the stability of document feeding is impaired, copied images may have a missing portion, or the number of paper jams may increase.

SUMMARY OF THE INVENTION

It is an object of the present invention to provide a document feeder which can feed documents at high speeds from a whole apparatus standpoint, without increasing the momentary transporting speed of the document feeding mechanism.

In order to achieve the above objective, the document feeder of the present invention for feeding documents to a document scanning section where the image of each document is scanned, is provided with: first feed means for feeding the document to the document scanning section; transport means for removing the document supplied thereto from the scanning section and sending the document to a transport path; reversing means for turning over the document by making the document, which is discharged by the transport means, pass through the transport path; second feed means for feeding to the document scanning section the document that has been turned over by the reversing means; and length adjusting means for adjusting the length of the actual document transport course of the transport path depending on the size of the document.

With the above arrangement, the first feed means feeds a document to the scanning section where the scanning operation of the image on one side of the document is started. The document supplied to the scanning section is then directed from the scanning section to the transport path by the transport means. Here, the document is turned over by the reversing means as it passes through the transport path, with the leading edge of the document being held by the second feed means until the rear edge of the document has passed over the document scanning section. The scanning operation of the image on the one side of the document has thus been completed. During this time, the transport means continues to transport the document from the scanning section to the transport path. Here, in the case where the length of the document is longer than the original length of the transport path, the length of the actual document transport course of the transport path is extended by the length adjusting means depending on the size of the document. Therefore, even a longer-size document can be fed to the transport path while the second feed means continues to hold the leading edge of the document. When the rear edge of the document has passed over the document scanning section and the scanning operation of the image on the one side of the document has been completed, the second feed means starts transporting the document, with the reversed side facing the scanning section, in the opposite direction to the direction in which the first feed means fed the document to the scanning section and thus the scanning operation of the image on the other side of the document is started. As described above, since the length of the actual document transport course of the transport path can be adjusted depending on the size of the document, the original length of the transport path is set to be shorter than before.

Accordingly, without increasing the momentary transporting speed of the document feeding mechanism that is constituted of the first feed means, the second feed means, the reversing means and the transport means, high-speed feeding of the documents can be achieved from a whole apparatus standpoint.

Moreover, in order to provide the adjustable length of the actual document transport course of the transport path, the transport path may have a reversing guide member forming the outer wall thereof, which is capable of moving forward or backward. In this case, the reversing guide member is designed so that it can move forward at a speed slightly faster than one-half the transport speed of the document, and move backward at a speed slightly slower than one-half the transport speed. With this arrangement, the documents are transported in the transport path guided by the reversing guide member, without excessive bending.

BRIEF DESCRIPTION OF THE DRAWINGS

Further scope of applicability of the present invention will become apparent form the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

For a fuller understanding of the nature and advantages of the invention, reference should be made to the ensuing detailed description taken in conjunction with the accompanying drawings which are given by way of illustration only, and thus are not limitative of the present invention, and wherein:

FIG. 1 is a longitudinal sectional view showing the structure of a document feeder.

FIG. 2 is a longitudinal sectional view showing the entire structure of a digital copying machine that is provided with the document feeder of an embodiment of the present invention.

FIGS. 3 through 8 are explanatory views showing the process of one-sided copying operation of the document.

FIGS. 9 through 14 are explanatory views showing the process of two-sided copying operation of the document.

FIG. 15 is a longitudinal sectional view showing the structure of a moving guide section.

FIG. 16 is a perspective view showing the main part of the moving guide section.

FIG. 17 is a block diagram showing the structure of a reversing transport section in the document feeder.

DETAILED DESCRIPTION OF THE PREFERRED EMBODIMENTS

The following description will discuss one embodiment of the present invention referring to FIGS. 1 through 17.

Figure 2:
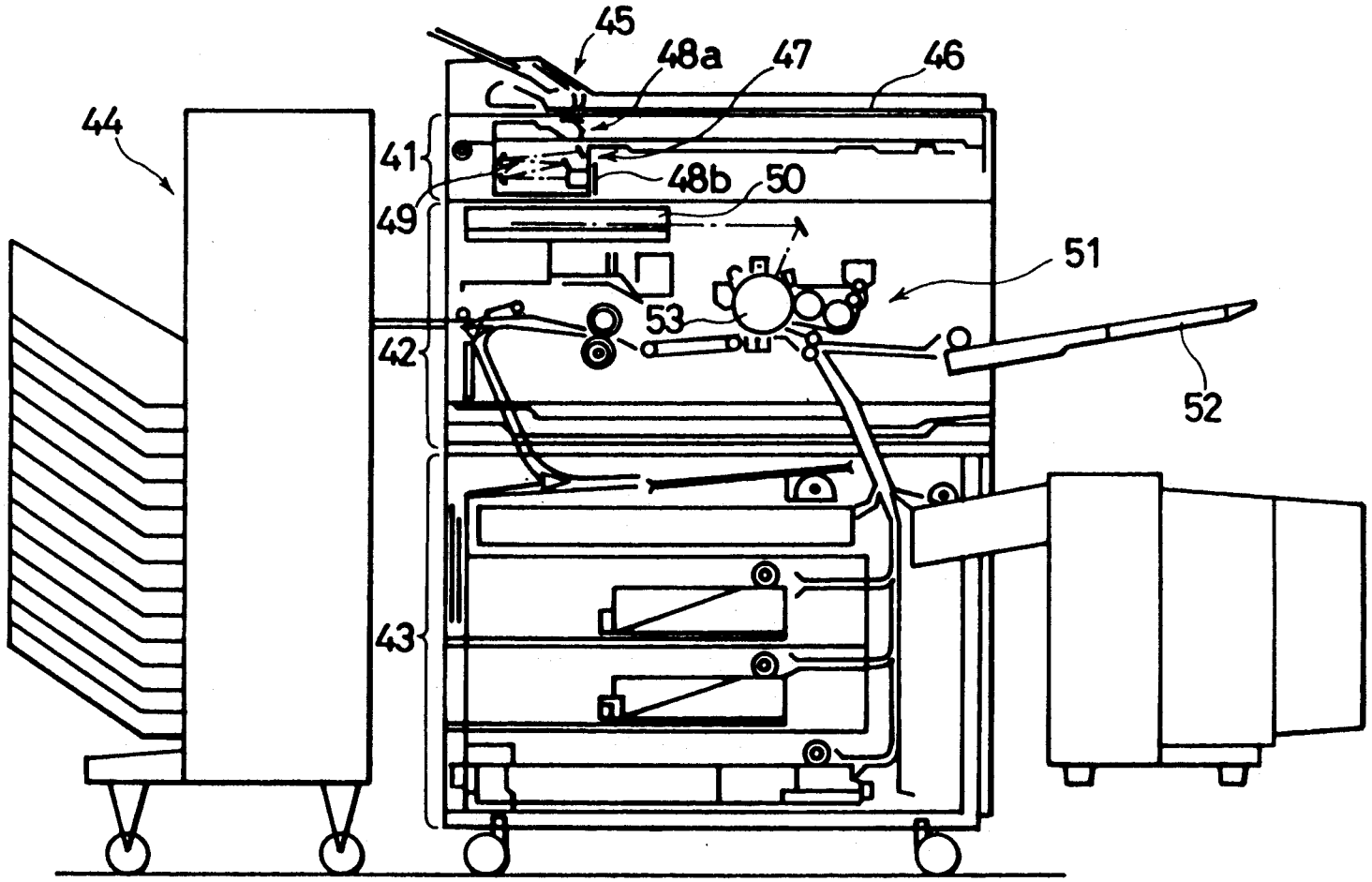
Figure 3:
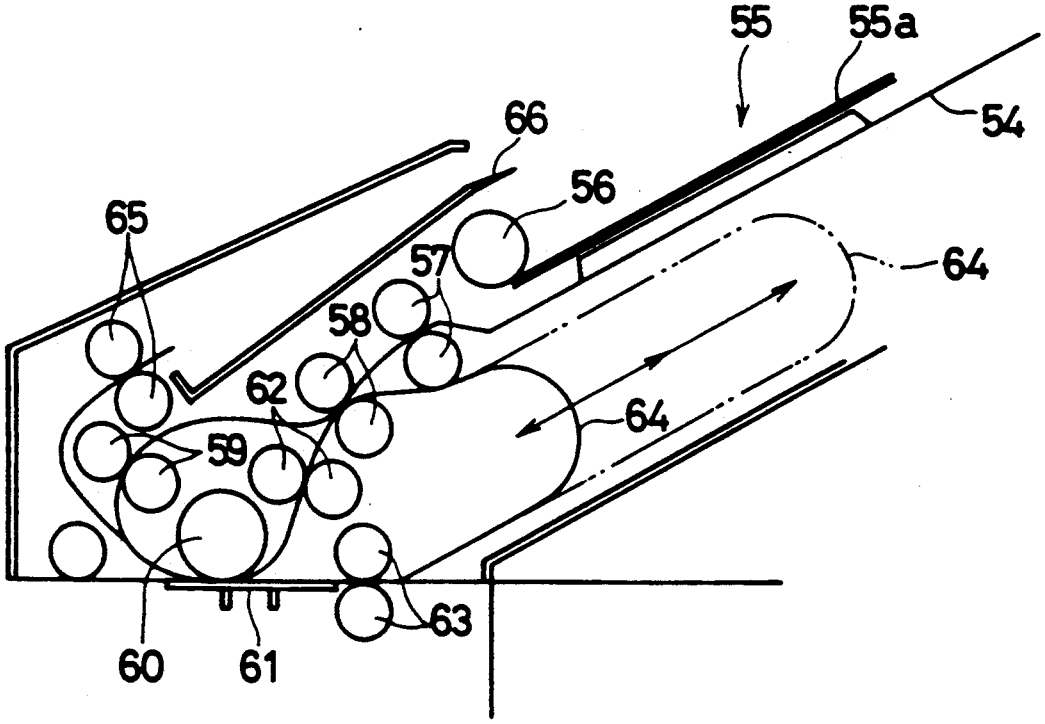

As shown in FIG. 2, a copying machine provided thereon with a document feeder 45 of the present invention, has a scanner section 41, a laser printer section 42, a multiline paper feed unit 43 and a sorter 44. Furthermore, the document feeder 45 is disposed on the scanner section 41.

The scanner section 41 includes a document platen 46 made of transparent glass and a scanner unit 47. An operating panel having various input keys, not shown, is provided on the scanner section 41.

The document feeder 45 is designed to automatically feed documents one by one when one or more documents are set therein, and the scanner unit 47 reads one side or two sides of the document according to the instruction of the operator.

The scanner unit 47 includes a lamp reflector assembly 48*a* for exposing the document and an optical system 49 for directing a light image that is reflected from the document to an optical/electrical conversion device, for example, a charge coupled device (CCD) 48*b*. In the case of scanning a document that is placed on the document platen 46, the scanner section 41 scans the document image while the scanner unit 47 is moved along the undersurface of the document platen 46. On the other hand, in the case when the document feeder 45 is used, the scanner section 41 scans the document image while the document is transported, the scanner unit 47 having been halted at a predetermined position below the document feeder 45.

Image data obtained by scanning the document image by the use of the scanner unit 47, after undergoing various processes known to the art, is temporarily stored in a memory, not shown. Then, the image data stored in the memory is supplied to the laser printer section 42 upon receiving an instruction to release the data so as to form an image on a sheet of copy paper.

The laser printer section 42 has a laser write unit 50 and an electrophotographic process section 51 for forming images.

The electrophotographic process section 51 has a charger, developing devices, a transfer device, a separator, a cleaner and a static eliminating device which are all disposed around a photoconductor drum 53. A latent image is formed on the surface of the photoconductor drum 53 by permitting a laser beam from the laser write unit 50 to scan thereon according to the image data read out from the memory. Then, the latent image formed on the surface of the photoconductor drum 53 is made visible by toner, and the toner image is electrostatically transferred and then fixed onto one side of a sheet of copy paper that is supplied from the multiline paper feed unit 43 or a manual paper tray 52.

The multiline paper feed unit 43 sends sheets of copy paper one by one from one of the cassettes toward the laser printer section 42.

Next, referring to FIGS. 3 through 14, the following description deals with the mechanism of the document feeder 45 of the present invention. In these figures, the document feeder is illustrated by using only the main parts of the document feeder 45 which will be described later.

The document feeder has a document tray 54, a pick-up roller 56, paired separation rollers 57, paired transport rollers 58, paired feed rollers 59, a document support drum 60, an original glass plate 61 in the scanner section 41 of FIG. 2, paired feed rollers 62, paired document discharge rollers 63, a reversing transport path 64, paired document ejection rollers 65, and a document discharge tray 66. Further, a plurality of documents 55 are placed on the document tray 54.

Figure 4:
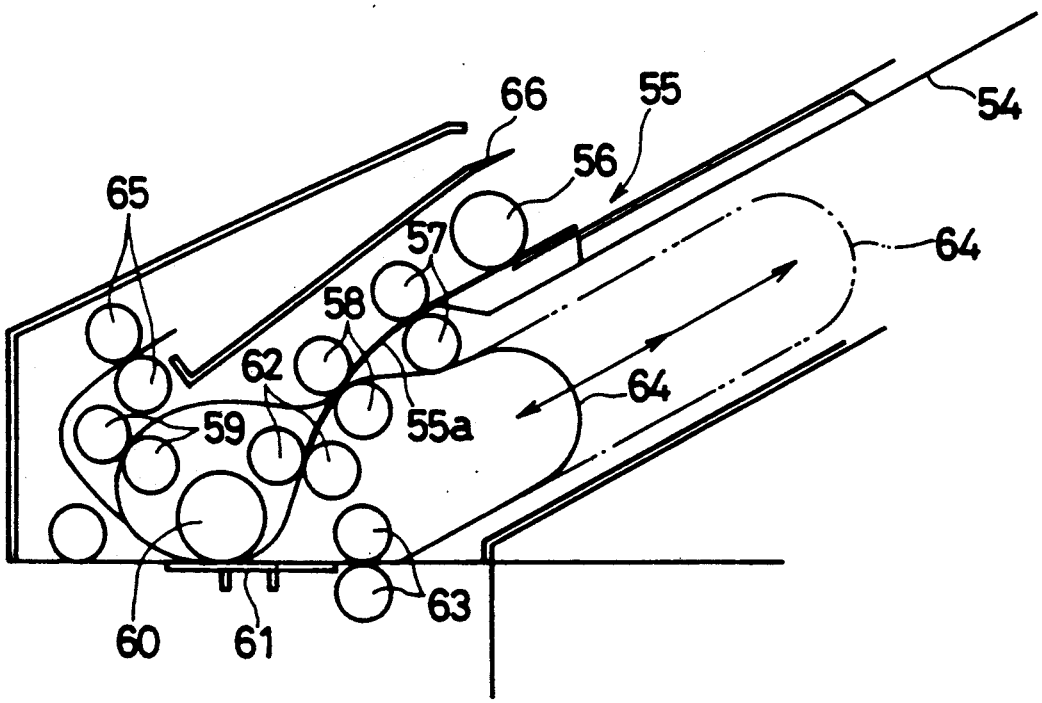

As shown in FIGS. 3 through 8, in a one-sided copying mode for copying one side of the document 55, the top document **55*a* of the plurality of the documents 55 that are placed on the document tray 54, is fed by the pick-up roller 56 (see FIG. 3), and transported through the paired separation rollers 57 and the paired transport rollers 58, until the leading edge of the document 55 is pinched by the paired feed rollers 62 (see FIG. 4**).

The first document **55*a* is next sent to a nip between the document support drum 60 and the original glass plate 61, where the document 55*a* is exposed and scanned by the scanner section 41**.

After having passed through the nip, the document **55*a* is sent to the paired document ejection rollers 65 by the document support drum 60, and ejected onto the document discharge tray 66**.

Figure 5:
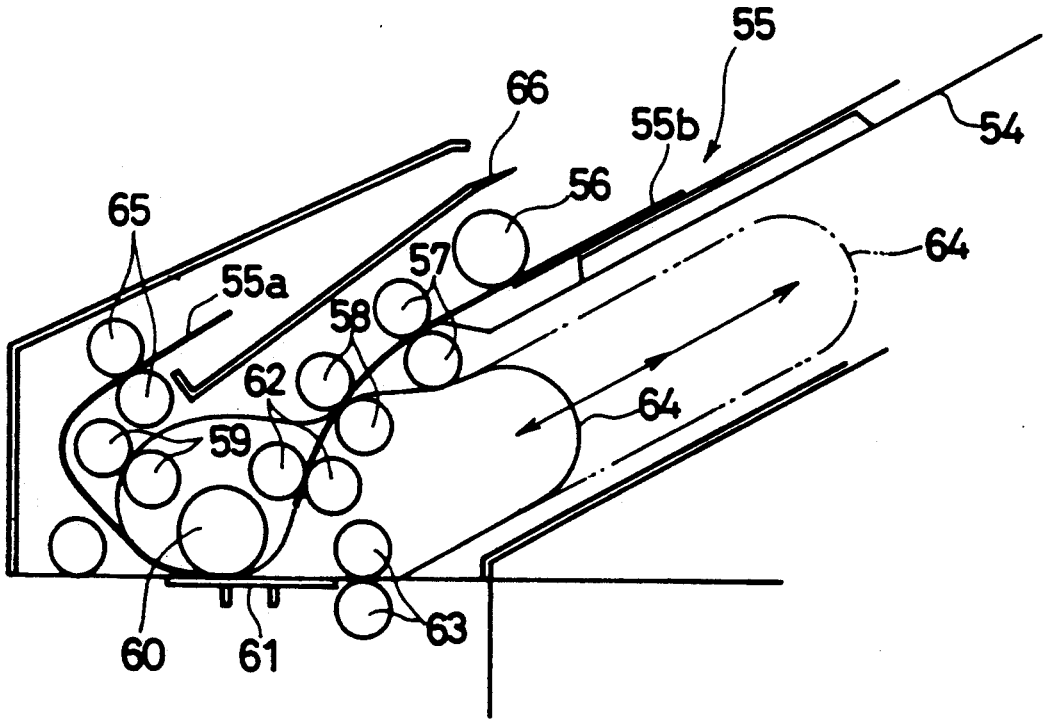
Figure 6:
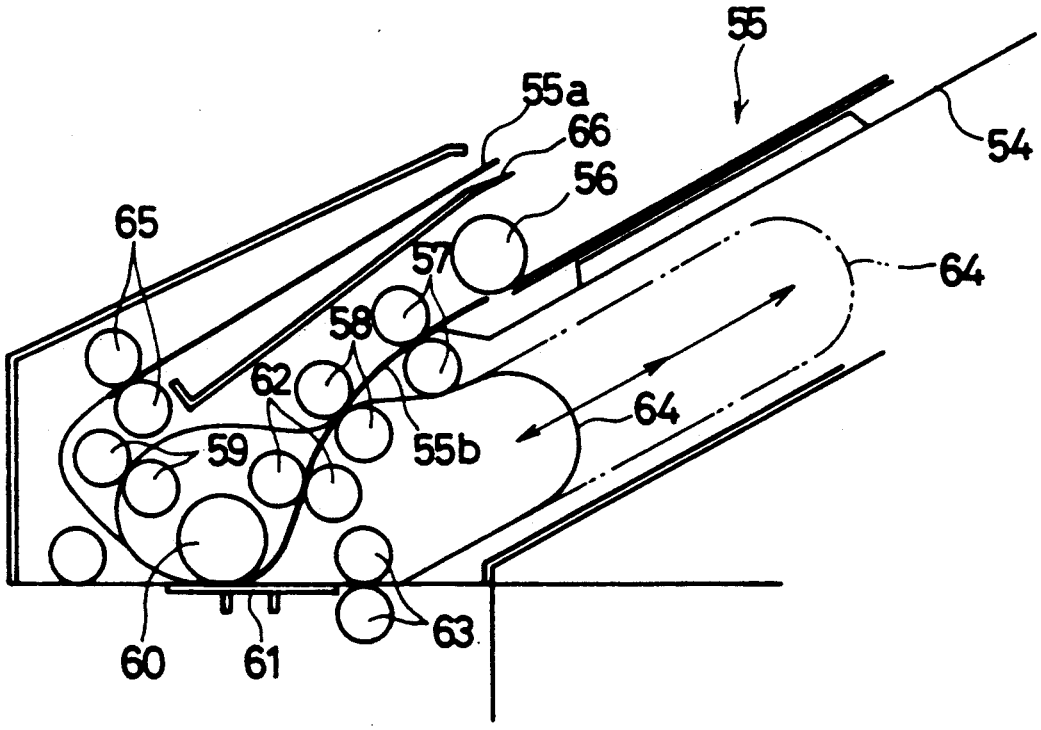

At this time, the second document **55*b* is in a stand-by state with its leading edge pinched by the paired feed rollers 62 after having been sent from the plurality of the documents 55 placed on the document tray 54 by the pick-up roller 56 (see FIG. 5**).

Figure 7:
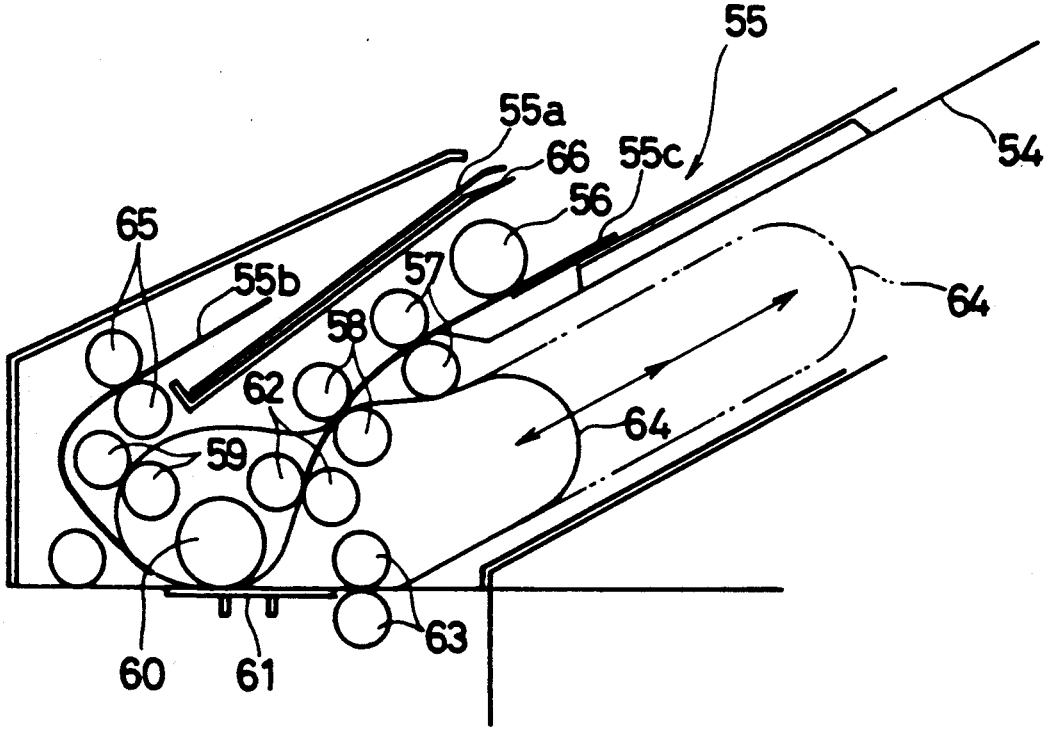

As with the first document **55*a*, the second document 55*b* passes through the nip between the document support drum 60 and the original glass plate 61 while being exposed and scanned by the scanner section 41 (FIG. 6), and is ejected onto the document discharge tray 66 (FIG. 7**).

Figure 8:
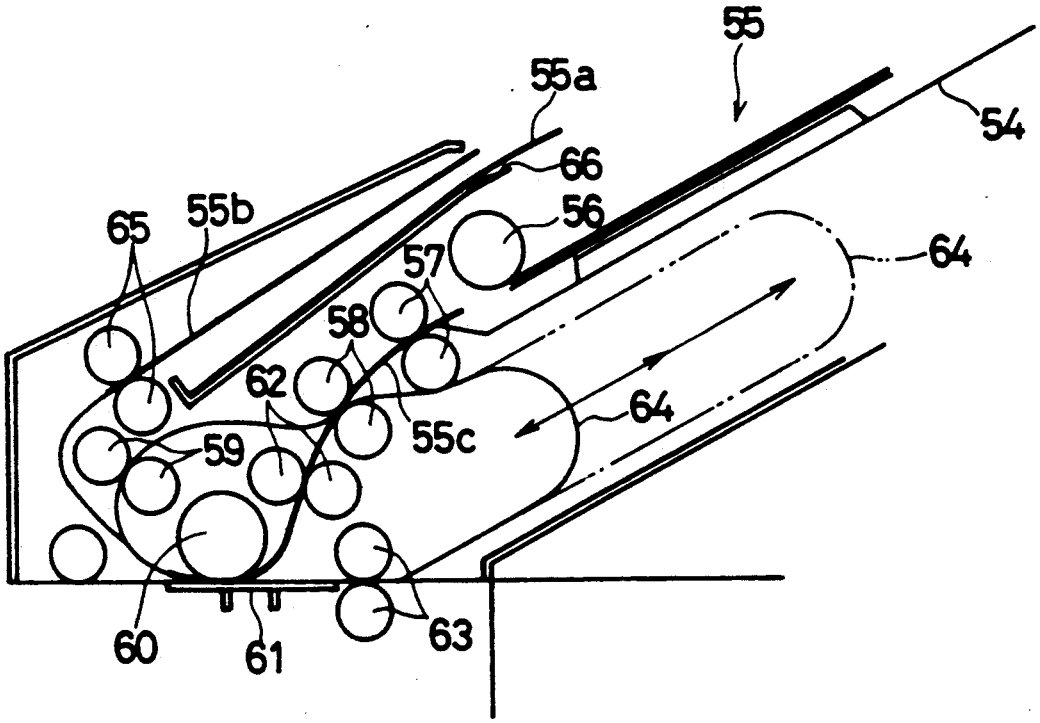

As to the third document **55*c* and thereafter, the same process including the transport by each pair of the rollers and exposure and scanning operations on the document by the scanner section 41, is repeated until the documents 55 have been fed from the document tray 54 (FIG. 8**).

Figure 9:
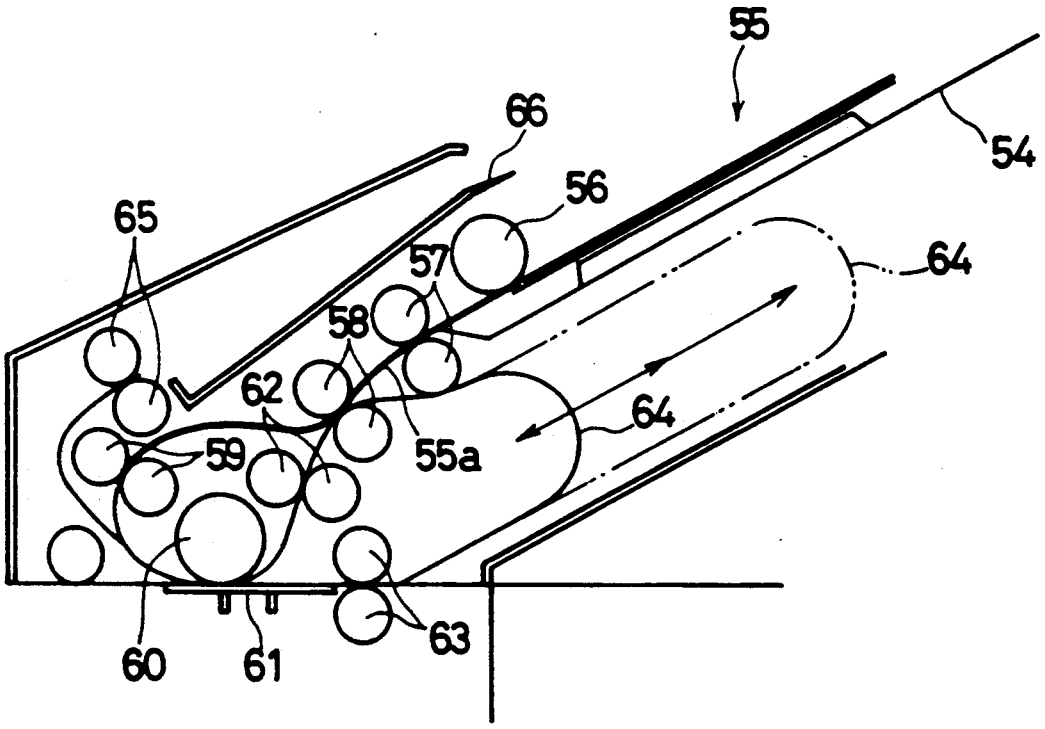

As shown in FIGS. 9 through 14, in a two-sided copying mode for copying two sides of the document 55, the top document **55*a* of the plurality of the documents 55 that are placed on the document tray 54, is fed by the pick-up roller 56, and then sent to the paired feed rollers 59 by way of the paired transport rollers 58 (see FIG. 9**).

Figure 10:
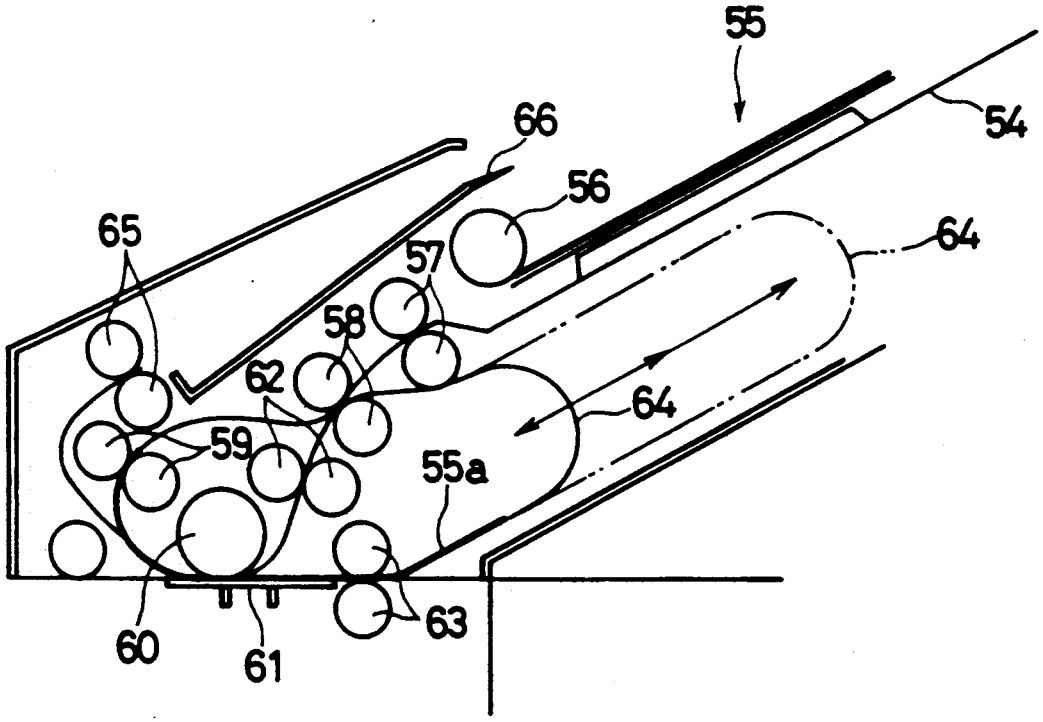
Figure 11:
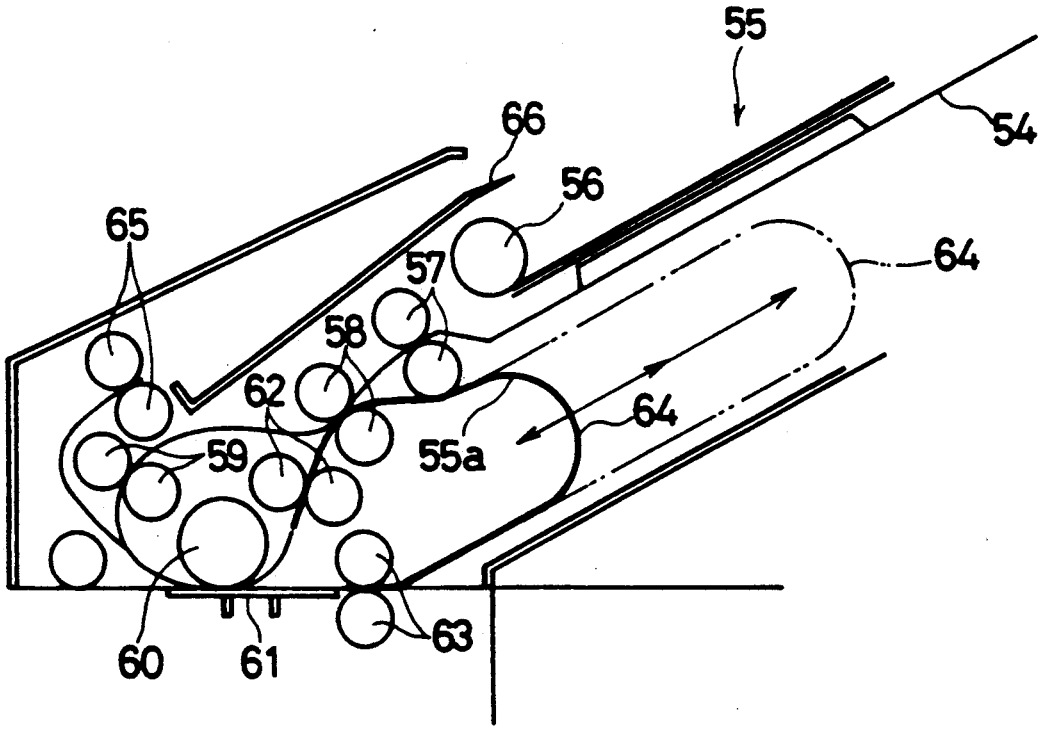

The document **55*a* is exposed and scanned on its first side by the scanner section 41 while being passed through the nip between the document support drum 60 and the original glass plate 61 in a direction opposite to the transport direction of the document of the one-sided copying mode (see FIG. 10**).

Thereafter, the document **55*a* is directed to the reversing transport path 64 by the paired document ejection rollers 63, and passes through the paired transport rollers 58 with its side reversed to that of the one-sided copying mode, and then is pinched by the paired feed rollers 62. The leading edge of the document 55*a* is stopped by being pinched by the paired feed rollers 62 to enter a stand-by state before exposure on the second side of the document 55*a* (see FIG. 11**).

If the document **55*a* is a long size sheet and its rear edge is still passing through the nip between the document support drum 60 and the original glass plate 61 while its leading edge is stopped by being pinched by the paired feed rollers 62, the paired document ejection rollers 63 continue to send the document 55*a*. In this case, as will be described later, the reversing transport path 64 is extended in such a manner that it is adapted to accept the document 55*a* that is sent from the paired document ejection rollers 63**.

Figure 12:
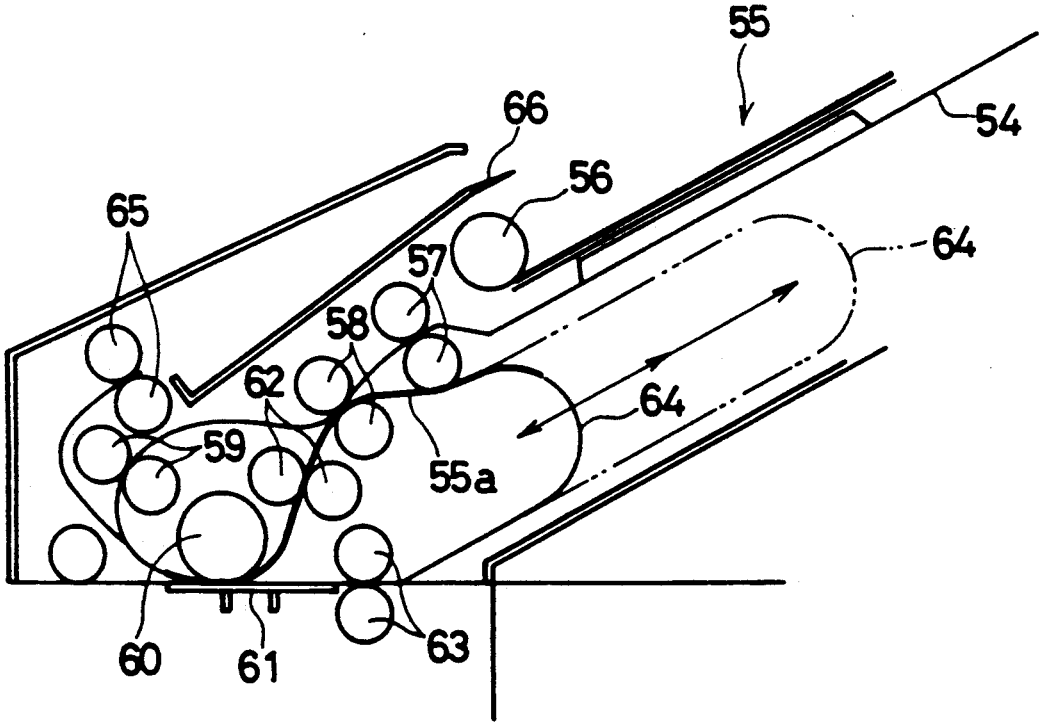
Figure 13:
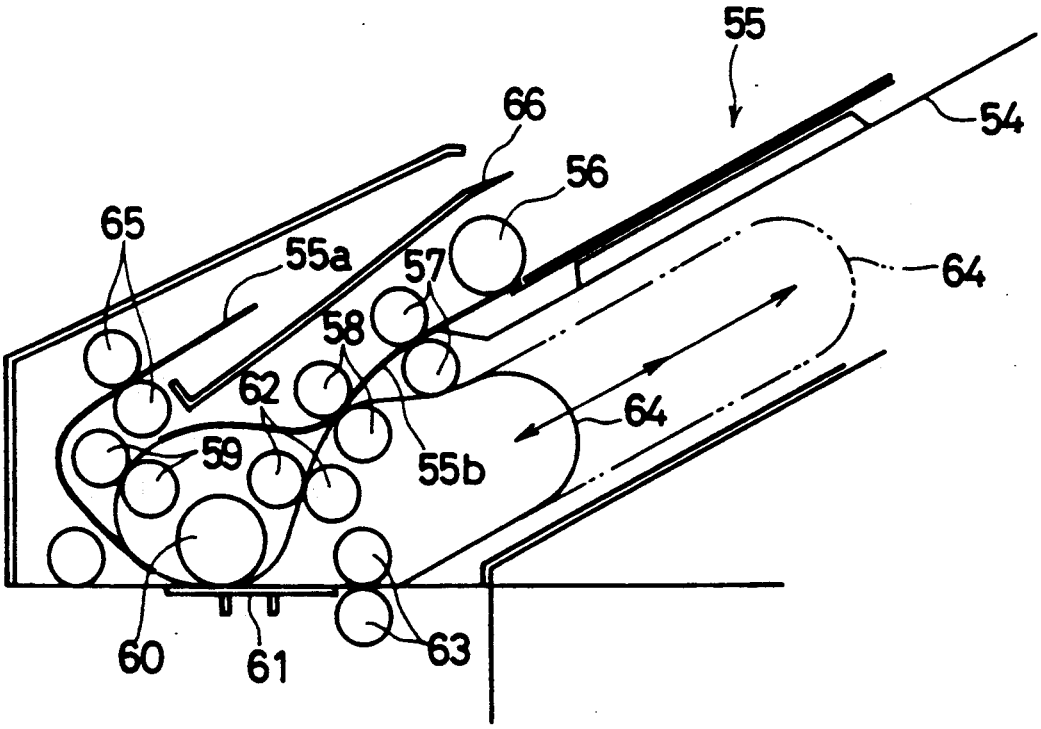

In this way, when the exposure and the scanning operation on the first side of the document **55*a* are completed, the paired feed rollers 62 resumes its rotation (see FIG. 12**}.

Figure 14:
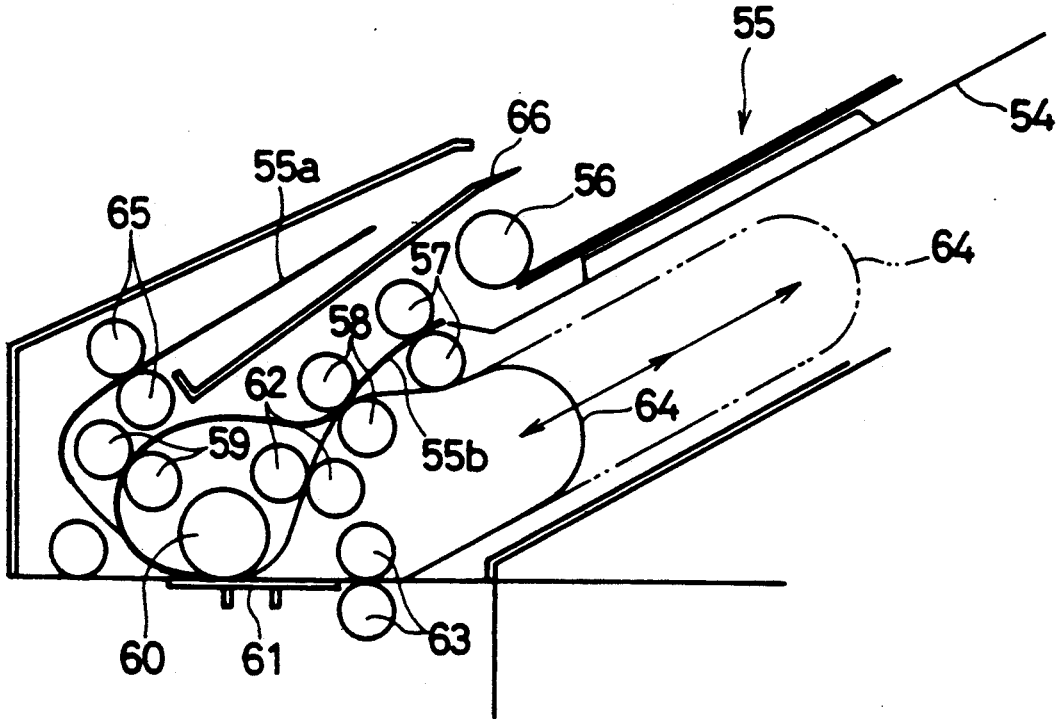

Exposure and a scanning operation on the second side of the document **55*a* are performed in the same manner as those of the aforementioned one-sided copying mode. When the first document 55*a* is discharged onto the document discharge tray 66 after copying two sides thereof, the second document 55*b* is fed at once (see FIG. 13), and exposure and a scanning operation on the first side of the document 55*b* are performed (FIG. 14**).

Thereafter, the same sequence is repeated until all the documents 55 on the document tray 54 have been fed.

Next, the following description will discuss one embodiment of the document feeder **45*a*** more precisely.

Figure 1:
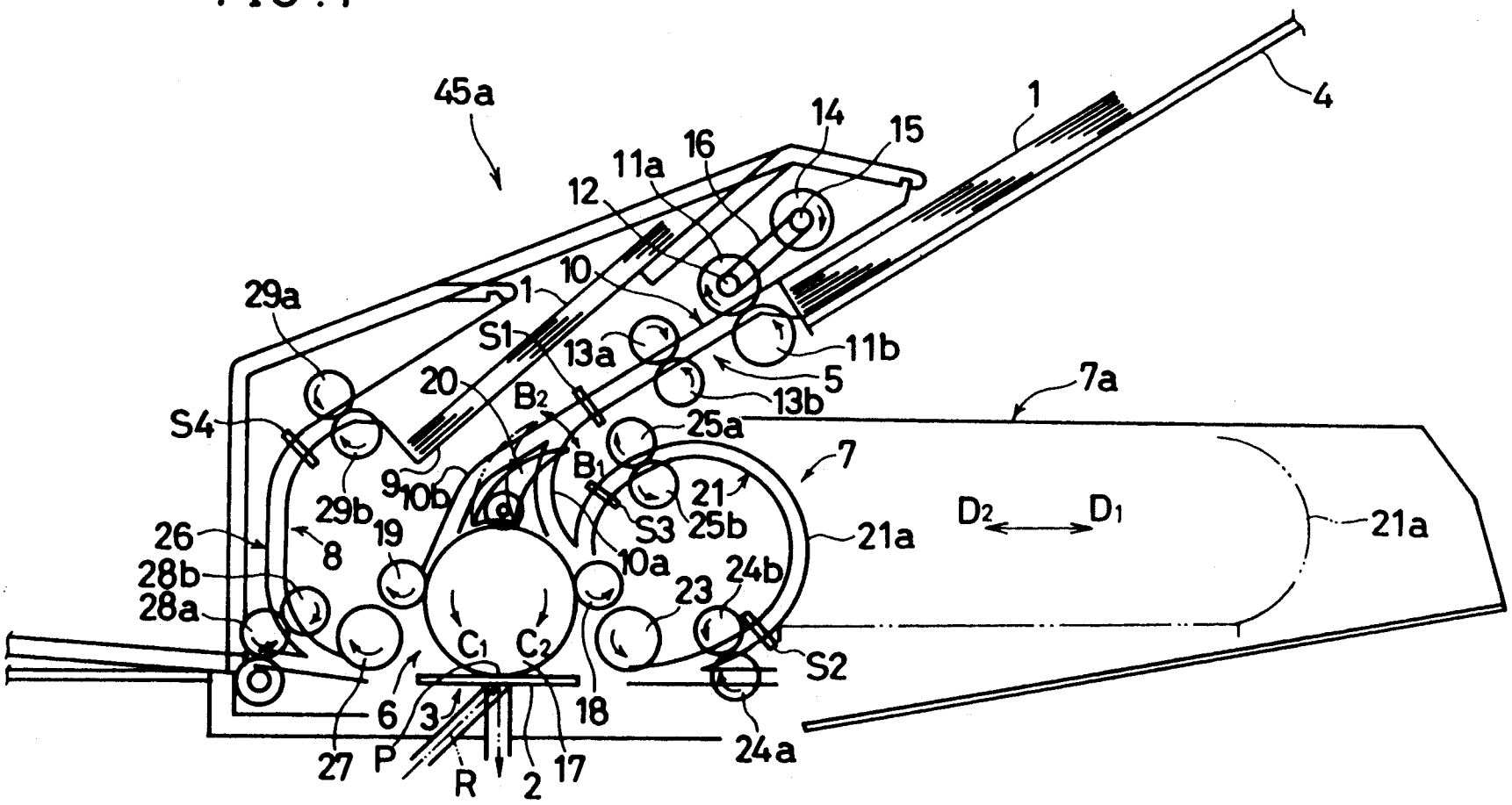
FIGS. 1 through 17 show one embodiment of the present invention.

As shown in FIG. 1, the document feeder **45*a* is an automatic document feeder capable of copying two sides of a sheet of paper, and it is designed to automatically feed documents one by one from a plurality of documents that are set in the document tray. Then, the scanner unit 47 of FIG. 2** scans one side or two sides of the document according to the instruction of the operator.

Here, for convenience of explanation, positions where various members are disposed are described according to relative positions of above or below and right or left as defined in FIG. 1.

As shown in FIG. 1, the document feeder **45*a* of the present embodiment includes a document tray 4 whereon a plurality of documents 1 are placed, a feed-use transport section 5 for transporting each of the documents 1 in the document tray 4 to an exposure-use transport section 6, an exposure section 3 where, at an exposure point P, each document 1 is scanned by a ray of light R projected from the scanner section 41 through an original glass plate 2, and the exposure-use transport section 6 for transporting the document 1 to the exposure section 3. The document feeder 45*a* also includes a reversing transport section 7 for turning over the document 1, which has been subjected to the scanning light at the exposure section 3, and for sending it to the exposure-use transport section 6, a discharge-use transport section 8 for transporting the document 1 having been subjected to the scanning light at the exposure section 3 to a document discharge tray 9, and the document discharge tray 9 for accommodating the documents 1 that are discharged after completion of the scanning operation by light applied thereto at the exposure section 3. This arrangement makes it possible to provide two-sided scanning by light at the exposure section 3 with respect to the document 1 by turning over the document 1 at the reversing transport section 7**.

The feed-use transport section 5 has a feed-use transport path 10, first feed-use transport rollers 11*a* and 11*b*, second feed-use transport rollers 13*a* and 13*b*, a motor 14, a first document sensor S1, and a change lever 20.

The feed-use transport path 10 is a communicating path between the document tray 4 and the exposure-use transport section 6, and branch paths 10*a* and 10*b* are formed at the lower end thereof so as to provide alternative routes. Further, the branch path 10*a* has its paper discharging opening near a contact point between a right pressure roller 18 and a document support drum 17, which will be described later. On the other hand, the branch path 10*b* has its paper discharging opening near a contact point between a left pressure roller 19 and the document support drum 17.

The first feed-use transport rollers 11*a* and 11*b*, which are in contact with each other, are disposed inside the feed-use transport path 10 near the document tray 4, and a rotating shaft 12 attached to the first feed-use transport roller 11*a* is rotated by a motor 14 since a transmission belt 16 is passed around the rotating shaft 12 and the driving shaft of the motor 14. Further, the second feed-use transport rollers 13*a* and 13*b*, which are in contact with each other, are disposed inside the feed-use transport path 10 at the downstream portion from the first feed-use transport rollers 11*a* and 11*b*.

The first document sensor S1 which is disposed inside the feed-use transport path 10 at the downstream portion from the second feed-use transport rollers 13*a* and 13*b*, is adapted to control the driving operations of the document support drum 17 and the change lever 20, which will be described later.

The change lever 20 is installed at the lower end of the feed-use transport path 10, and capable of pivoting in either direction $B_1$ or $B_2$. When the one-sided copying mode is selected and the leading edge of the document 1 is detected by the first document sensor S1, the change lever 20 is turned on and it is pivoted from the direction $B_1$ (shown by a solid line in FIG. 1) to the direction $B_2$ shown by an alternate long and two short dashes line, whereby the communicating path at the lower end of the feed-use transport path 10 is connected to the branch path 10*a*. Here, the state of the change lever 20 that is pivoted in the direction $B_1$ represents the off state. On the other hand, when the two-sided copying mode is selected, the change lever 20 is kept in the off state, that is, remains pivoted in the direction $B_1$ even if the leading edge of the document 1 is detected by the first document sensor S1, whereby the communicating path at the lower end of the feed-use transport path 10 is connected to the branch path 10*b*.

The exposure-use transport section 6 has the document support drum 17 and the right and left pressure rollers 18 and 19.

The document support drum 17 is disposed between the lower end of the feed-use transport path 10 having the branch paths 10*a*, 10*b* and the exposure section 3. Here, the document support drum 17 is disposed so that its outer surface comes into contact with the original glass plate 2 at the exposure point P formed thereon. Further, the document support drum 17 is capable of rotating in either $C_1$ or $C_2$ direction. When the one-sided copying mode is selected and the leading edge of the document 1 is detected by the first document sensor S1, the document support drum 17 is rotated in the direction $C_2$. On the other hand, when the two-sided copying mode is selected and the leading edge of the document 1 is detected by the first document sensor S1, it is rotated in the direction $C_1$.

The right pressure roller 18 is disposed so as to be in contact with the outer surface of the document support drum 17, which is situated at the document discharge opening of the branch path 10*a*, while the left pressure roller 19 is disposed so as to be in contact with the outer surface of the document support drum 17, which is situated at the document discharge opening of the branch path 10*b*.

The reversing transport section 7 includes a reversing transport path 21, a right document discharge roller 23, first reversing transport rollers 24*a* and 24*b*, second reversing transport rollers 25*a* and 25*b*, a second document sensor S2 and a third document sensor S3.

The right document discharge roller 23, which is disposed at the entrance of the reversing transport path 21, directs the document 1 to the reversing transport path 21, which has passed over the exposure point P of the exposure section 3 from left to right.

The loop-shaped reversing transport path 21 has its document feed opening located near the right side of the original glass plate 2 and has its document discharge opening located near the contact point between the document support drum 17 and the right pressure roller 18. Here, the outer wall of the reversing transport path 21 functions as a reversing guide 21*a* that is a length adjusting means.

The reversing guide 21*a* is movable forward or backward in either $D_1$ or $D_2$ direction in a moving guide section 7*a* depending on the size of the document 1 that is detected by the second and third document sensors S2 and S3, which will be described later. When the reversing guide 21*a* is moved in the direction $D_2$ to the end (shown by a solid line in FIG. 1), the length of the document path of the reversing transport path 21 becomes shortest. On the other hand, as it is moved in the direction $D_1$ (shown by an alternate long and two short dashes line), the length of the document path of the reversing transport path 21 increases.

Figure 15:
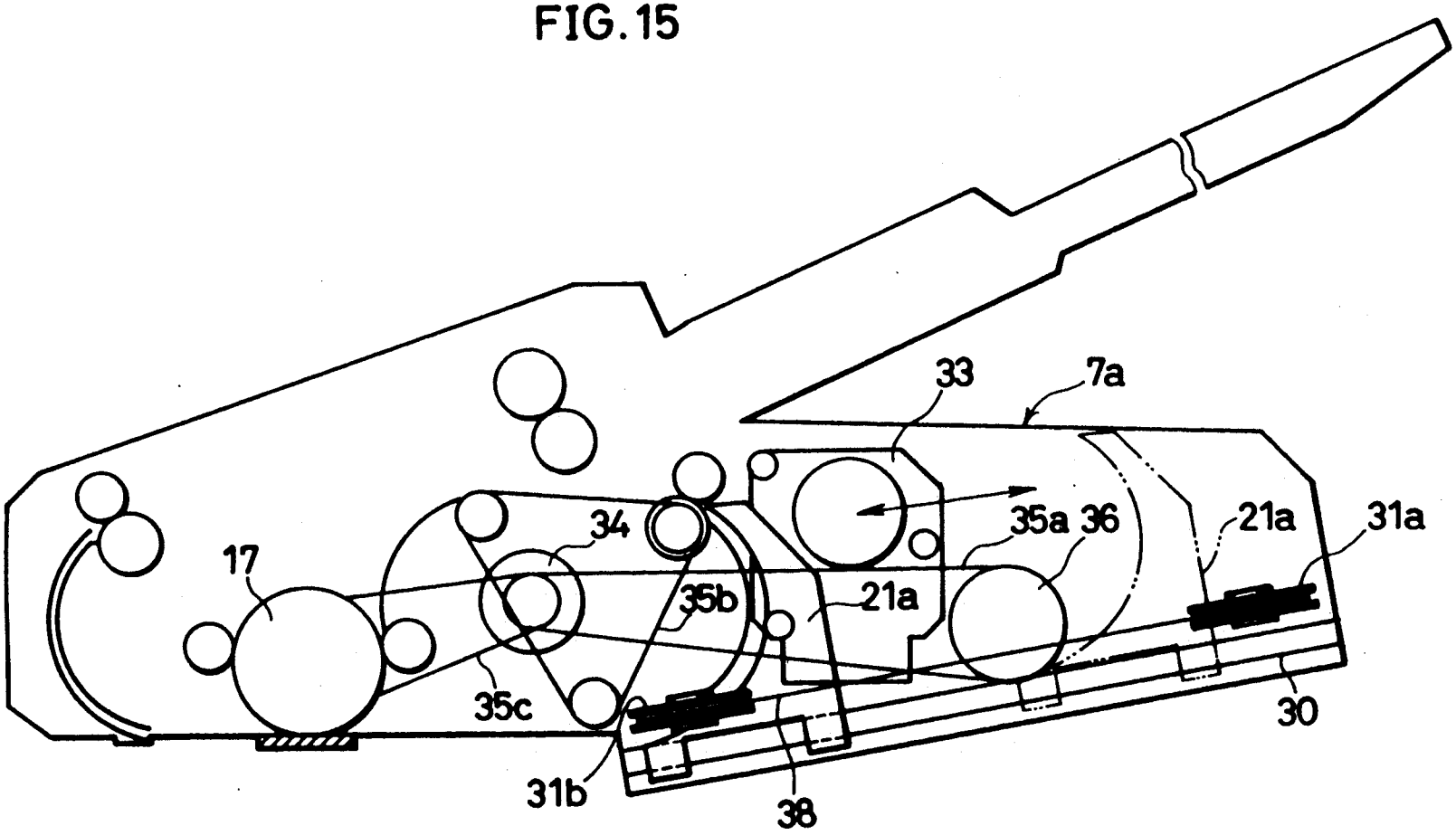
Figure 16:
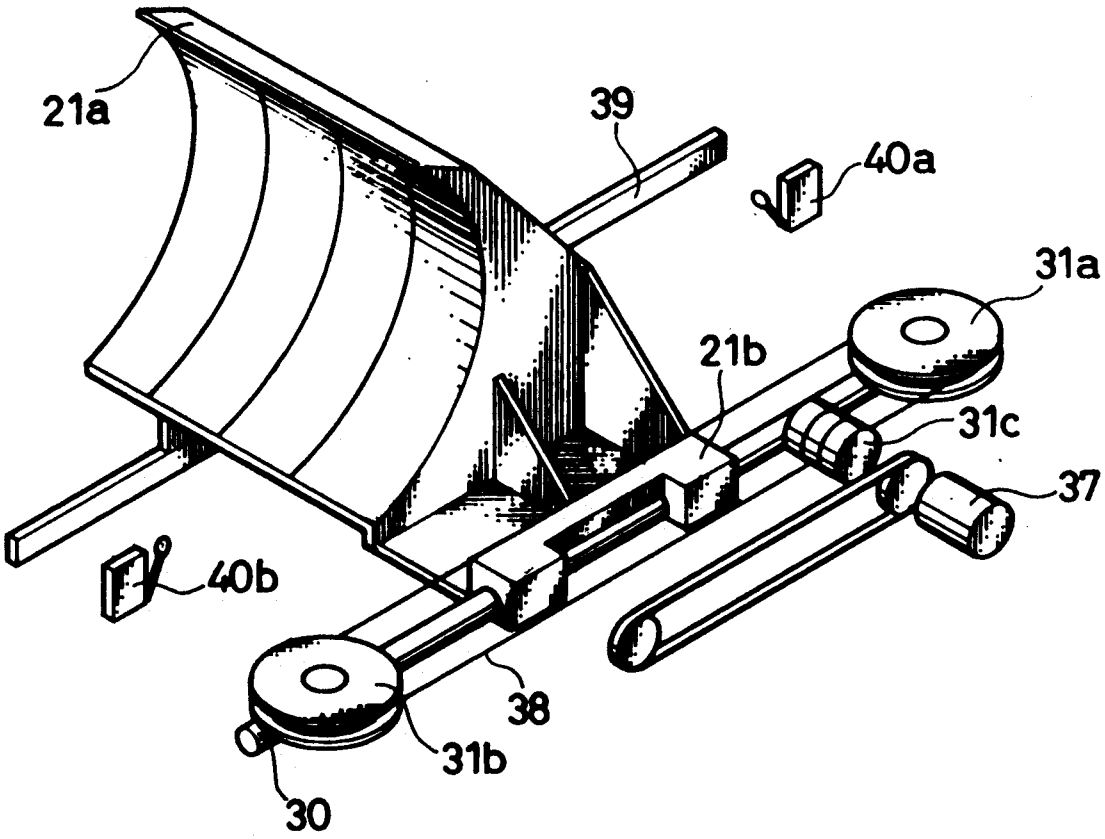

As shown in FIG. 15, the moving guide section 7*a* is provided with a main motor 33, and the main motor 33 drives a main gear 34 to rotate, and then the rotation is transmitted to the rollers for transporting the document and the reversing guide 21*a* by way of belts 35*a* through 35*c*. As shown in FIG. 16, the reversing guide 21*a* is coupled to a guide shaft 30 through a coupling section 21*b*, and a wire 38 engaged by pulleys 31*a* through 31*c* is secured to the coupling section 21*b*. The driving force of the main gear 34 is transmitted to a gear 36 through the belt 35*a*, and the driving force of the gear 36 is transmitted to the pulleys 31*a* through 31*c* by way of a clutch 37, if necessary, so as to move the reversing guide 21*a*. Further, the movement of the reversing guide 21*a* is controlled by limit switches 40*a* and 40*b* attached to the respective ends.

The first reversing transport rollers 24*a* and 24*b* shown in FIG. 1 which are in contact with each other, are disposed at the upper end of the reversing transport path 21, while the second reversing transport rollers 25*a* and 25*b* which are in contact with each other, are disposed at the lower end of the reversing transport path 21. The first reversing transport rollers 24*a*, 24*b* and the second reversing transport rollers 25*a*, 25*b* are controlled by the respective second and third document sensors S2 and S3 in their rotation operation.

Figure 17:
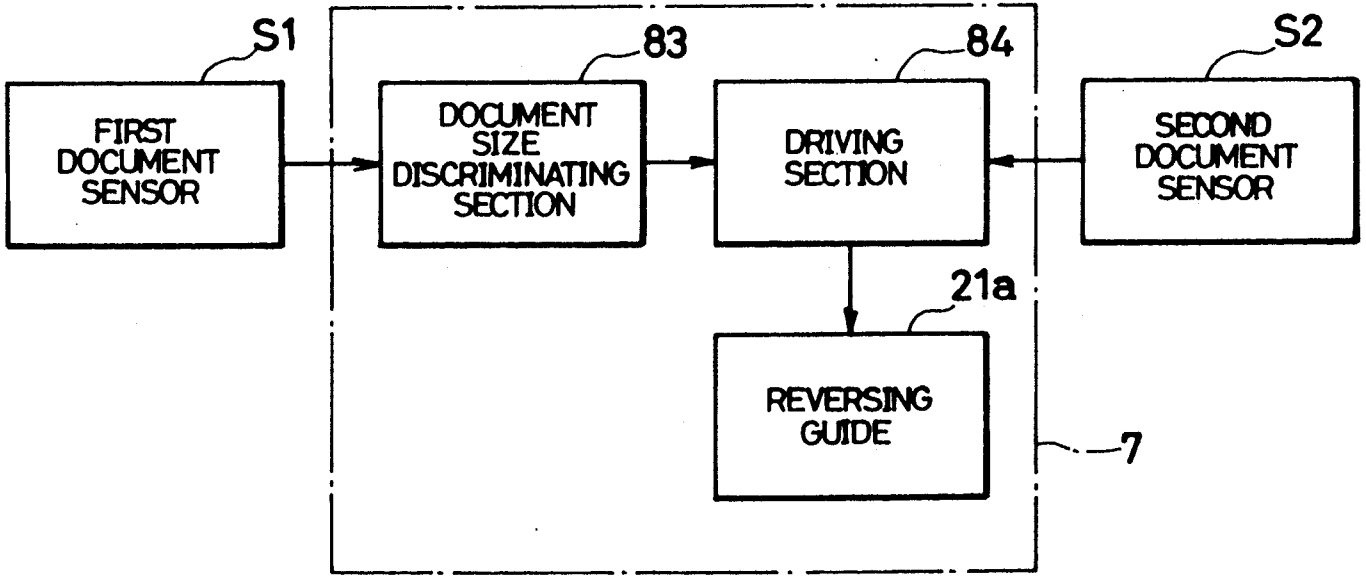

Moreover, as shown in FIG. 17, the reversing transport section 7 is constituted by ;a document size discriminating section 83 that is connected to the first document sensor S1, a driving section 84 that is connected to the document size discriminating section 83 and the second document sensor S2, and the reversing guide 21aconnected to the driving section 84.

The document size discriminating section 83 receives a signal representing the size of the document 1, which is released from the first document sensor S1, and discriminates the size of the document 1 detected by the first document sensor S1, according to the entered signal.

The driving section 84 receives a signal representing the discrimination result by the document size discriminating section 83, and moves the reversing guide 21a by a predetermined distance according to the discrimination result entered thereto. Further, upon receiving a signal from the second document sensor S2 representing the detection of the rear edge of the document 1, the driving section 84 drives the reversing guide 21a so that it returns to the most recessed position according to the signal entered thereto.

The second document sensor S2 is disposed in the reversing transport path 21 at the downstream portion from the first reversing transport rollers 24a and 24b, while the third document sensor S3 is disposed in the reversing transport path 21 at the downstream portion from the second reversing transport rollers 25a and 25b. When the third document sensor S3 detects the leading edge of the document 1 in the state where the rear edge of the document 1 has not been detected by the second document sensor S2, it stops the rotating operation of the second reversing transport rollers 25a and 25b. At this time, the document 1 is still being transported by the rotating operation of the first reversing transport rollers 24a and 24b, resulting in natural bending of the document 1 in the reversing transport path 21. Here, simultaneously as the rotation of the second reversing transport rollers 25a and 25b is stopped, the reversing guide 21a is moved forward in the direction $D_1$ at a speed slightly faster than one-half the transport speed of the document 1 in the reversing transport path 21. With this arrangement, the reversing transport path 21 provides room wide enough for the document 1 to absorb the natural bending.

Thereafter, when the second document sensor S2 detects the rear edge of the document 1 in the state where the reversing guide 21a is moving forward in the direction $D_1$, it permits the second reversing transport rollers 25a and 25b to resume the rotating operation and also permits the reversing guide 21a to move backward in the direction $D_2$ at a speed slightly slower than one-half the transport speed of the document 1.

The discharge-use transport section 8 has a discharge-use transport path 26, a left document discharge roller 27, first discharge-use transport rollers 28a and 28b, document ejection rollers 29a and 29b, and a fourth document sensor 4.

The discharge-use transport path 26 has its document feed opening located near the left side of the original glass plate 2 and has its document discharge opening located near the document discharge tray 9, and it forms a communicating path for transporting onto the document discharge tray 9 the document 1 that has been subjected to the scanning light at the exposure section 13.

The left paper discharge roller 27 is disposed at the document feed opening of the discharge-use transport path 26, and adapted to direct into the discharge-use transport path 26 the document 1 that has passed over the exposure point P of the exposure section 3 from right side to the left side.

The first discharge-use transport rollers 28a and 28b which are in contact with each other, are disposed at the upper end of the discharge-use transport path 26, while the document ejection rollers 29a and 29b which are in contact with each other, are disposed at the lower end of the discharge-use transport path 26.

The fourth document sensor S4 is disposed in the discharge-use transport path 26 at the lower end between the first discharge-use transport rollers 28a, 28b and the document ejection rollers 29a, 29b. The fourth document sensor S4 detects discharge of the document 1 onto the document discharge tray 9 by detecting the rear edge of the document 1.

According to the above arrangement, the following description will discuss the transport processes of the document 1 in the one-sided copying mode and the two-sided copying mode with respect to the document feeder 45a of the present embodiment.

First, in the one-sided copying mode on the document 1, various copying modes (such as one-sided document, the number of sheets to be copied, copying density, etc.) are specified through a key input means on an operating panel, not shown, after setting a plurality of documents 1 onto the document tray 4. When the print switch on the operating panel is turned on, the motor 14 in the feed-use transport section 5 drives the first feed-use transport rollers 11a and 11b so as to feed the top document 1 of the documents 1 that are placed on the document tray 4.

Next, when the leading edge of the document 1, which has been fed as described above, reaches the first document sensor S1, the first document sensor S1 is turned on, and thus the change lever 20 is turned on and driven to rotate in a direction $B_2$; the feed-use transport path 10 is switched to the branch path 10a at the lower end thereof; and the document support drum 17 is driven to rotate in a direction $C_2$. Here, the document 1 passes through the branch path 10a being guided by the side face of the change lever 20, and then feeding of the document 1 is temporarily stopped in the state where the document is sandwiched between the document support drum 17 and the right pressure roller 18 after a predetermined time has been counted since the first document sensor S1 was turned on.

Then, the feeding is resumed to send the document 1 to the exposure point P on the original glass plate 2 in synchronism with the irradiation of an outgoing ray of light R to be applied to the exposure section 3. Thus, the document 1, with its leading edge being pressed onto the document support drum 17, passes over the exposure point P which is a contact point between the document support drum 17 and the exposure glass 2, from the right side to the left side, without having excessive bending.

After having passed over the exposure point P for scanning as described above, the document 1 is sent to the left document discharge roller 27, and then ejected onto the document discharge tray 9 through the discharge-use transport path 26 by means of the first discharge-use transport rollers 28a, 28b and the document ejection rollers 29a, 29b. At this time, the fourth document sensor S4, which is disposed between the first discharge-use transport rollers 28*a*, 28*b* and the document ejection rollers 29*a*, 29*b*, detects the discharge of the document 1 onto the document discharge tray 9.

When a document sensor (not shown), which is attached to the document tray 4, senses that all the documents 1 on the document tray 4 have been subjected to the one-sided copying process, as described above, the operation is completed. Here, when the documents 1 are continuously copied as described above, it is designed that the following document 1 is fed from the document tray 4 in synchronism with the passage of the rear edge of the preceding document 1 over the exposure point P.

Next, in the two-sided copying mode on the document 1, various copying modes (such as two-sided document, the number of sheets to be copied, copying density, etc.) are specified through a key input means on an operating panel, not shown, after setting a plurality of documents 1 onto the document tray 4. When the print switch on the operating panel is turned on, the motor 14 in the feed-use transport section 5 drives the first feed-use transport rollers 11*a* and 11*b* so as to feed the top document 1 of the documents 1 that are placed on the document tray 4.

Next, when the leading edge of the document 1, which has been fed as described above, reaches the first document sensor S1, the first document sensor S1 is turned on, and the document support drum 17 is driven to rotate in a direction $C_1$. At this time, the change lever 20 is in the off state, and the feed-use transport path 10 is opened to the branch path 10*b* at the lower end thereof. Here, the document 1 passes through the branch path 10*b* being guided by the side face of the change lever 20, and then feeding of the document 1 is temporarily stopped in the state where the document is sandwiched between the document support drum 17 and the left pressure roller 19 after a predetermined time has been counted since the first document sensor S1 was turned on.

Then, the feeding is resumed to send the document 1 to the exposure point P on the original glass plate 2 in synchronism with the irradiation of an outgoing ray of light R to be applied to the exposure section 3. Thus, the document 1, with its leading edge being pressed onto the document support drum 17, passes over the exposure point P which is a contact point between the document support drum 17 and the exposure glass 2, from the left side to the right side, without having excessive bending. After having passed over the exposure point P for scanning as described above, the document 1 is sent to the right document discharge roller 23, and then transported to the third document sensor S3 by the first reversing transport rollers 24*a* and 24*b* through the reversing transport path 21.

When the leading edge of the document 1 reaches the third document sensor S3, the third document sensor S3 is turned on. At this time, if the second document sensor S2 has detected the rear edge of the document 1, the document 1 is transported from the inside of the reversing transport path 21 to the exposure-use transport section 6 by the rotation of the second reversing transport rollers 25*a* and 25*b*, with the reversing guide 21*a* being kept in the most recessed position in the direction $D_2$. On the other hand, if the second document sensor S2 has not detected the rear edge of the document 1, the rotation of the second reversing rollers 25*a* and 25*b* is stopped, and the reversing guide 21*a* is moved forward in the direction $D_1$ at the speed slightly faster than one-half the transport speed of the document 1, and thereby the document 1 is sent into the reversing transport path 21 without having excessive bending at the rear portion thereof. In this case, the leading edge of the document 1 is stopped in the state where it is sandwiched between the second reversing rollers 25*a* and 25*b*.

Thereafter, when the second document sensor S2 document 1 in the state where the reversing guide 21*a* is moving forward in the direction $D_1$, it permits the second reversing transport rollers 25*a*and 25*b* to resume the rotation operation and also permits the reversing guide 21*a* to move backward in the direction $D_2$ at the speed slightly slower than one-half the transport speed of the document 1 such that the document 1 is transported from the inside of the reversing transport path 21 to the exposure-use transport section 6.

Then, the feeding is resumed to send the document 1 to the exposure point P on the original glass plate 2 in synchronism with the irradiation of an outgoing ray of light R to be applied to the exposure section 3. Thus, the document 1, with its leading edge being pressed onto the document support drum 17, passes over the exposure point P which is a contact point between the document support drum 17 and the exposure glass 2, from the right side to the left side, without having excessive bending. At this time, the document 1 is turned over so that the side that has been copied is now facing upwards in the preceding scanning operation.

When it is detected by the document sensor, not shown, attached to the document tray 4 that all the documents 1 on the document tray 4 have been fed after the repeated two-sided copying process of the document 1 for each of the documents 1 as described above, the two-sided copying operation on the documents 1 is completed.

As described above, in the document feeder 45*a* of the present invention, the reversing transport section 7 has the reversing transport path 21 that is provided with the reversing guide 21*a*, and the reversing guide 21*a* is movable forward or backward in either $D_1$ or $D_2$ direction depending on the size of the document 1. With this arrangement, the length of the actual document path of the reversing transport path 21 for turning over the document 1 is made adjustable depending on the size of the document 1. This allows the reversing transport section 7 to perform a suitable reversing operation of the document 1 depending on the size of the document 1, thus achieving high processing speeds of the document 1 in the two-sided copying operation.

Moreover, with the reversing guide 21*a* for making the length of the reversing transport path 21 adjustable, the forward moving speed is set to be slightly faster than one-half the transport speed of the document 1, while the backward moving speed is set to be slightly slower than one-half the transport speed of the document 1. This arrangement makes it possible to smoothly guide the document 1 by means of the reversing guide 21*a* without disturbing the transport of the document 1 both in the forward moving operation wherein the document 1 is transported into the reversing transport path 21 and in the backward moving operation wherein the document 1 is transported from the reversing transport path 21 to the exposure-use transport section 6. Thus, smooth transport of the document 1 without causing excessive bending in the reversing transport path 21 can be achieved independent o any size of the document 1.

Figure 18:
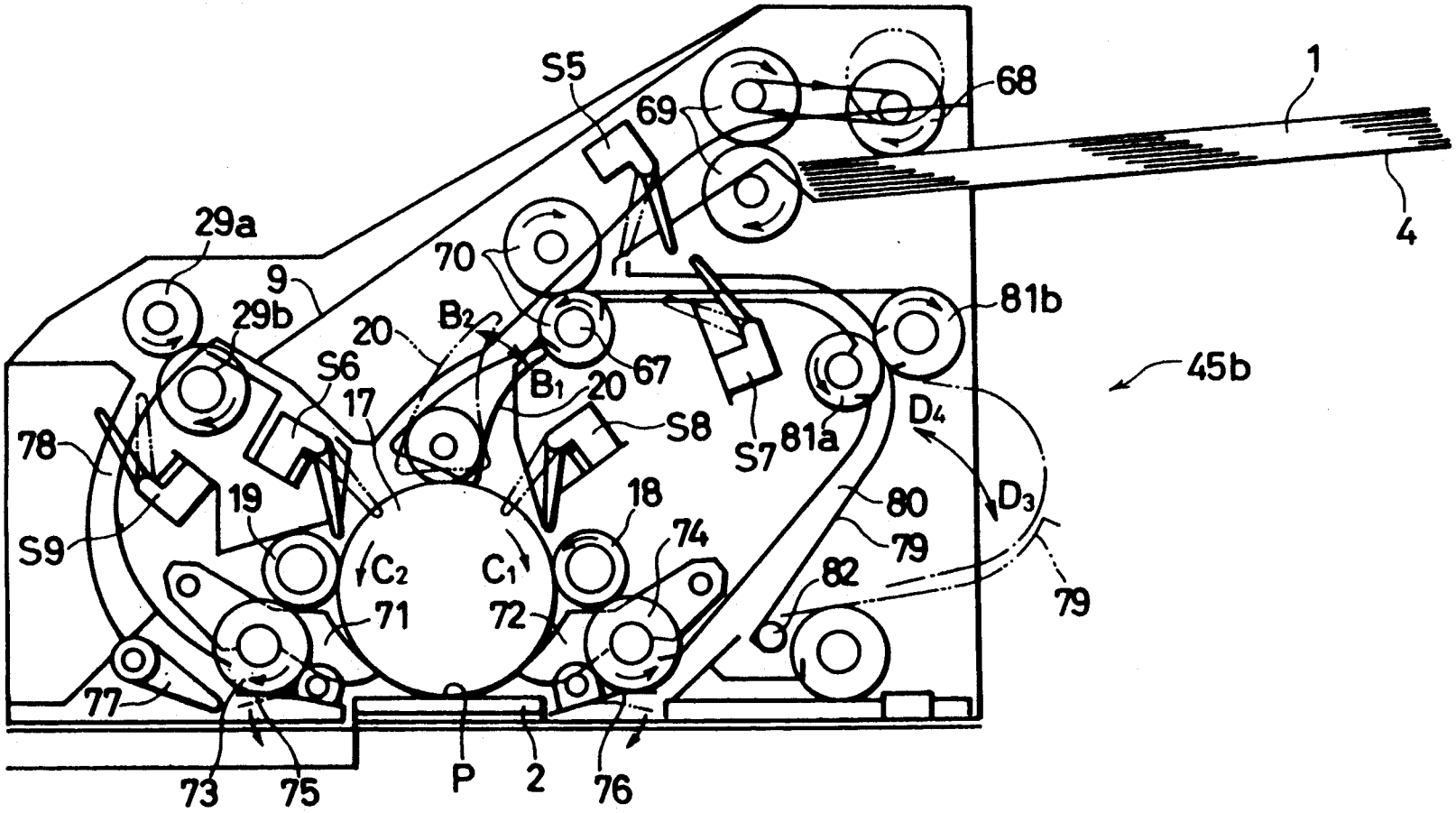
FIG. 18 is a longitudinal sectional view showing the structure of a document feeder that is another embodiment of the present invention.

Next, referring to FIG. 18, the following description will discuss another example of the document feeder 45 of the present invention. Here, those members having the same functions and described in the first embodiment are indicated by the same reference numerals and the description thereof is omitted.

As illustrated in FIG. 18, a document feeder 45*b* is provided with a main motor (whose output shaft is shown by reference numeral 67) having an electromagnetic clutch, and a rotative driving force of the main motor is transmitted to various rollers which will be described later through suitable known transmission means, not shown.

The document feeder 45*b* has a pick-up roller 68, paired feed rollers 69, paired transport rollers 70, a change lever 20, a document support drum 17 (which are driven through the electromagnetic clutch, not shown), a right pressure roller 18 and a left pressure roller 19 both of which are geared to the document support drum 17 so as to transport the document 1, right and left document guides 71 and 72, an original glass plate 2, right and left document discharge rollers 73 and 74, and solenoid-driven right and left movable guides 75 and 76 that are geared to the respective document discharge rollers 73 and 74. The document feeder 45*b* also includes a solenoid-driven movable document discharge guide 77, a document discharge-use transport path 78, document ejection rollers 29*a* and 29*b*, a document discharge tray 9, a document reversing guide 79 that is allowed to pivot by a solenoid between the position shown by a solid line and the position shown by an alternate long and two short dashes line, a reversing transport path 80 one side of which is provided with the document reversing guide 79, reversing transport rollers 81*a* and 81*b* that are driven through the electromagnetic clutch, a document tray 4, and a pivotal shaft 82.

There are disposed document sensors S5 to S9 in a path through which the document 1 is transported, and signals that are released from the respective sensors S5 to S9 when they detect the document 1 are sent to a control section, not shown. This control section permits the document 1 to be transported over the exposure point P on the original glass plate 2, as will bedescribed later, by actuating the various electromagnetic clutches and solenoids with predetermined timing which will be described later.

In order to transport the document, the two paired feed rollers 59 and 62 are used in the arrangement shown in FIGS. 3 through 8 as well as FIGS. 9 through 14. On the other hand, in the arrangement of the embodiment shown in FIG. 18, the document 1 is transported by the right and left feed rollers 18 and 19 that are operated in cooperation with the document support drum 17, and a nip between the document support drum 17 and the original glass plate 2 is set to be greater than the thickness of the document 1. Therefore, it is designed that even in the case where the right and left pressure rollers 18 and 19 are stopped with the document 1 sandwiched between the document support drum 17 and those rollers, the document discharge rollers 73 and 74 can pass the document 1 over the exposure point P.

In the above arrangement, the following description will discuss the operation of the document feeder 45*b* in its one-sided copying mode of the document.

In the one-sided copying mode on the document 1, various copying modes (such as one-sided document, the number of sheets to be copied, copying density, etc.) are specified through a key input means on an operating panel, not shown, after setting a plurality of documents 1 onto the document tray 4.

When the print switch on the operating panel is turned on, the main motor of the document feeder 45*b* starts to rotate. Next, the clutch of the pick-up roller 68 is turned on, and the rotating pick-up roller 68 feeds the top document of the documents 1 that are placed on the document tray 4. At this time, the clutch of the paired transport rollers 70 is simultaneously turned on, thereby permitting the paired transport rollers 70 to rotate.

When the leading edge of the document 1 thus transported reaches the document sensor S5, the solenoid of the change lever 20 is excited in such a manner that the change lever 20 is pivoted in a direction $B_2$ to be shifted from the position shown by a solid line to the position shown by an alternate long and two short dashes line. As the feeding of the document 1 further continues, the leading edge of the document 1 is guided along the side face of the change lever 20 and directed to the document sensor S8.

After the leading edge of the document 1 has been detected by the document sensor S8, the transport of the document 1 is temporarily stopped synchronously as the document 1 is held by the document support drum 17 and the right pressure roller 18. Then, synchronous with to the scanner unit 47 of FIG. 2, the transport of the document 1 is resumed in such a manner that the document 1 is transported to the exposure point P of the original glass plate 2.

The document 1 is pressed onto the surface of the document support drum 17 by the document guide 72 located at the right, and is permitted to pass over the exposure point P clockwise without causing excessive bending. At this time, the scanner unit 47 of FIG. 2 reads out the image data of the document 1 at the exposure point P.

The document 1, after having passed over the exposure point P, is transported to the document discharge roller 73 on the left passing under the document guide 71 located at the left. Synchronously, as the leading edge of the document 1 reaches the document discharge roller 73, the solenoid of the movable guide 75 at the left is excited, and the movable guide 75 is pressed to the document discharge roller 73 with the document 1 sandwiched in-between. Thus, the document 1 is transported by friction force of the document discharge roller 73.

The leading edge of the document 1 that is transported by being pinched by the movable guide 75 and the document discharge roller 73, is guided along the upper face of the movable document discharge guide 77, and the document 1 is discharged onto the document discharge tray 9 by the document ejection rollers 29*a* and 29*b* by way of the document discharge-use transport path 78. The document sensor S9 attached to the document discharge-use transport path 78 is used for discriminating whether or not the document 1 is discharged onto the document discharge tray 9 by detecting the rear edge of the document 1.

In the case where a plurality of documents 1 are set on the document tray 4, the following document is fed synchronously as the rear end of the preceding document passes over the exposure point P. Further, there is a sensor, not shown, attached to the document tray 4, which detects whether any documents 1 are set thereon or not. The above-mentioned process is repeated until all the documents 1 have been fed, by the use of the sensor.

On the other hand, in the two-sided copying mode on the document 1, various copying modes (such as two-sided document, the number of sheets to be copied, copying density, etc.) are specified through the input keys on the operating panel, not shown, after setting a plurality of documents 1 onto the document tray 4.

When the print switch on the operating panel is turned on, the main motor of the document feeder 45*b* starts to rotate. Then, the rotating pick-up roller 68 feeds the top document of the documents 1 that are placed on the document tray 4.

When the leading edge of the document 1 thus transported reaches the document sensor S5, the clutch of the paired transport rollers 70 is turned on, and the paired transport rollers 70 are driven to rotate. At this time, the solenoid of the change lever 20 remains in the non-excited state, and the change lever 20 is located at the position shown by a solid line; therefore, the leading edge of the document 1 is guided toward the document sensor S6.

The transport of the document 1 is temporarily stopped in the state where the leading edge of the document 1, which has passed through the sensor S6, is sandwiched between the document support drum 17 and the left pressure roller 19. Then, synchronous with the scanner unit 47 of FIG. 2, the transport of the document 1 is resumed in such a manner that the document 1 is transported to the exposure point P of the original glass plate 2.

The document 1, while being pressed onto the surface of the document support drum 17 by the document guide 71 located at the left, is permitted to pass over the exposure point P counterclockwise without causing excessive bending. Thus, scanning on the first side of the document 1 is started.

The document 1, after having passed over the exposure point P, is transported to the document discharge roller 74 on the right, passing under the document guide 72 located at the right. Synchronously, as the leading edge of the document 1 reaches the document discharge roller 74, the solenoid of the movable guide 76 at the right is excited, and the movable guide 76 is pressed to the document discharge roller 74 with the document 1 sandwiched in-between.

The document 1 that is transported by being pinched by the movable guide 76 and the document discharge roller 74, is directed to the reversing transport path 80, and transported to the document sensor S7 by the reversing transport rollers 81*a* and 81*b*.

When the leading edge of the document 1 reaches the document sensor S7, the solenoid of the document reversing guide 79 is excited, and the document reversing guide 79 pivots on the pivotal shaft 82 in a direction $D_3$, thereby opening the reversing transport path 80. Simultaneously, the solenoid of the change lever 20 is excited, and the change lever 20 pivots in a direction $B_2$ so that it shifts its position from that which is shown by the solid line to that shown by an alternate long and two short dashes line.

The leading edge of the document 1 is further directed to the paired transport rollers 70 by the reversing transport rollers 81*a* and 81*b*, and guided along the side face of the change lever 20 that has been shifted to the position shown by the alternate long and two short dashes line, so as to reach the document sensor S8. Then, the transport of the document 1 is temporarily stopped at the time when the leading edge of the document 1 is sandwiched by the document support drum 17 and the right pressure roller 18.

In this state, if the length of the document 1 is longer than the length of the reversing transport path (the length from the contact point of the document support drum 17 and the right pressure roller 18 to the contact point of the movable guide 76 and the document discharge roller 74 by way of the document sensor S8, the change lever 20, the paired transport rollers 70, the document sensor S7, the reversing transport rollers 81*a*, 81*b* and the reversing transport path 80), the portion of the document 1 positioned behind the reversing transport rollers 81*a* and 81*b* is allowed to spontaneously become bow-shaped as shown by an alternate long and short dash line in FIG. 18 between the document-pinching point of the reversing transport rollers 81*a*, 81*b* and that of the movable guide 76 and the document discharge roller 74. Although the leading edge of the document 1 is in the state of stoppage, this function is possible because the reversing transport path 80 is opened by the pivotal movement of the document reversing guide 79.

As to the degree of opening of the reversing transport path 80 adjusted by the pivotal movement of the document reversing guide 79, it may be predeterminately set so that the reversing transport path 80 is opened depending on the size of the document, which is, for example, detected by a document size detection device, not shown, or specified by the operator through the input keys of the operating panel.

Then, after the rear edge of the document 1 has passed over the exposure point P, synchronous with the scanner unit 47, the transport of the document 1 is resumed in such a manner that the document 1 is transported to the exposure point P on the original glass plate 2.

The document 1, while being pressed onto the surface of the document support drum 17 by the document guide 72, is permitted to pass over the exposure point P clockwise without causing excessive bending. The scanner unit 47 reads out the image data of the document 1 at the exposure point P.

The document 1, after having passed over the exposure point P, is transported to the document discharge roller 73 on the left, passing under the document guide 71 located at the left. Synchronously, as the leading edge of the document 1 reaches the document discharge roller 73, the solenoid of the movable guide 75 at the left is excited, and the movable guide 75 is pressed to the document discharge roller 73 with the document 1 sandwiched in-between; thus the document 1 is transported.

After the image-reading operation on the second side of the document 1 has been completed, the solenoid of the document reversing guide 79 enters the non-excited state, and the document reversing guide 79 is thus returned to the position shown by the solid line, entering the stand-by state to direct the leading edge of the next document to the reversing transport rollers 81*a* and 81*b*.

The document 1 that is transported by being pinched between the movable guide 75 and the document discharge roller 73, is guided along the upper face of the movable document discharge guide 77, and discharged onto the document discharge tray 9 by the document ejection rollers 29*a* and 29*b* by way of the document discharge-use transport path 78.

In the case where a plurality of documents 1 are set on the document tray 4, the document feeder 45*b* is designed in such a manner that the following document is fed synchronously as the rear end of the preceding document passes over the exposure point P in the second scanning process by exposure.

This operation can be repeated until all the documents 1 have been fed.

With the arrangement of the above embodiment, since the length of the reversing transport path 80 can be varied by the document reversing guide 79, larger-size documents can be fed to the reversing transport path 80 even if the original length of the reversing transport path 80 is shorter than the length of those documents. Further, it is possible to make the reversing transport path 80 shorter, and thus high-speed feeding of the documents can be achieved from a whole apparatus standpoint, without increasing the momentary transporting speed of the document transport mechanism including the right and left pressure rollers 18 and 19, the document discharge roller 74, the movable guide 76 and other members.

In this way, high-speed image processing can be achieved, and damage of the document can be minimized even if a paper jam occurs. Further, since the stable feeding of the documents is attained, it is possible to avoid drawbacks such as paper jams and having a missing portion in the copied images.

In the above embodiment, when two sides of the document are scanned, the scanning direction for one side is different from that for the other side. Here, another arrangement may be adopted, wherein the first side of the document is read out and the data is stored, and the scanning direction is coincided when the image on the second side is transferred onto a sheet of copy paper.

Moreover, the direction of the copy paper may be reversed before the image on the second side is transferred onto the other side of the copy paper.

Figure 19:
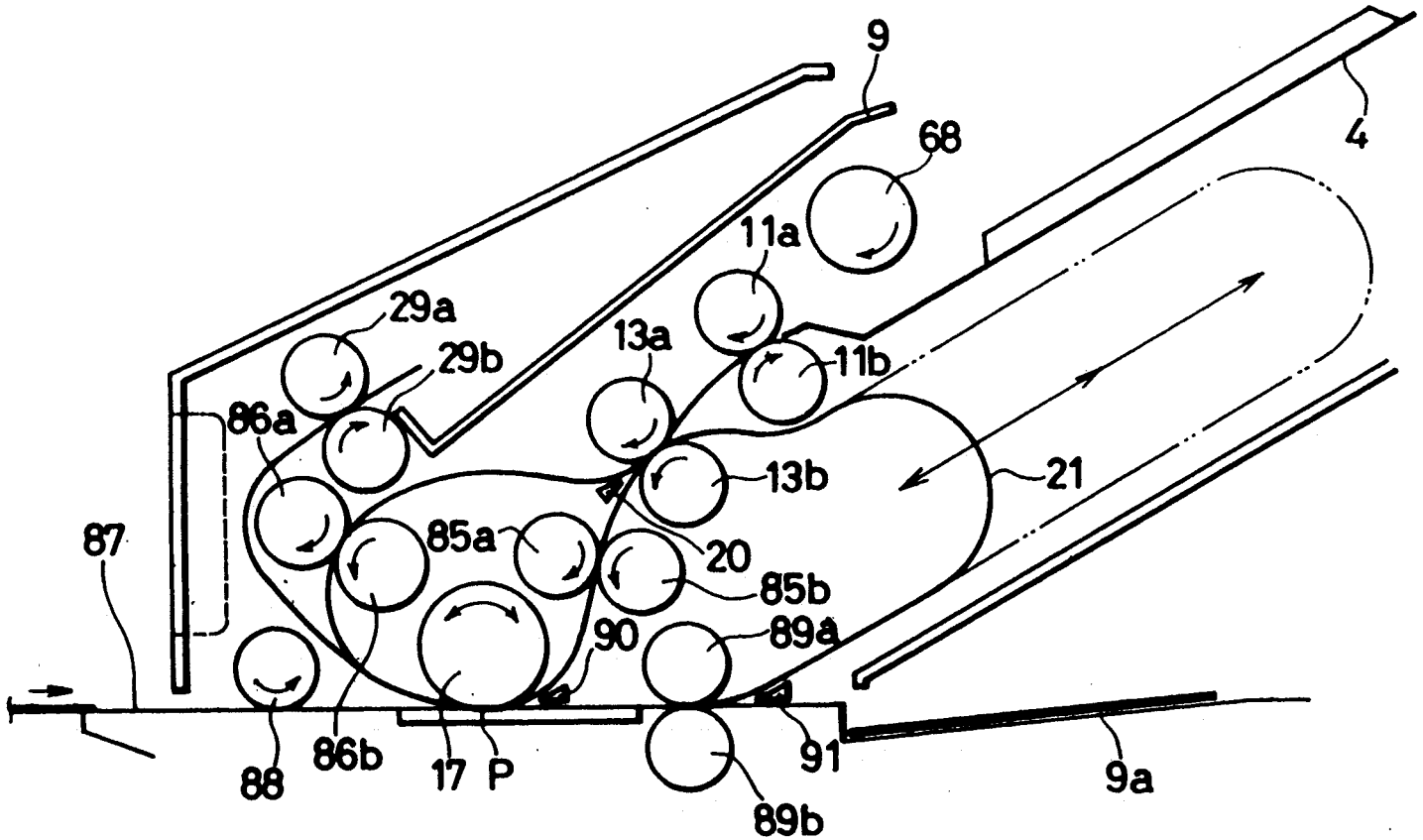
FIG. 19 is a longitudinal sectional view showing the structure of a document feeder that is still another embodiment of the present invention.
Figure 20:
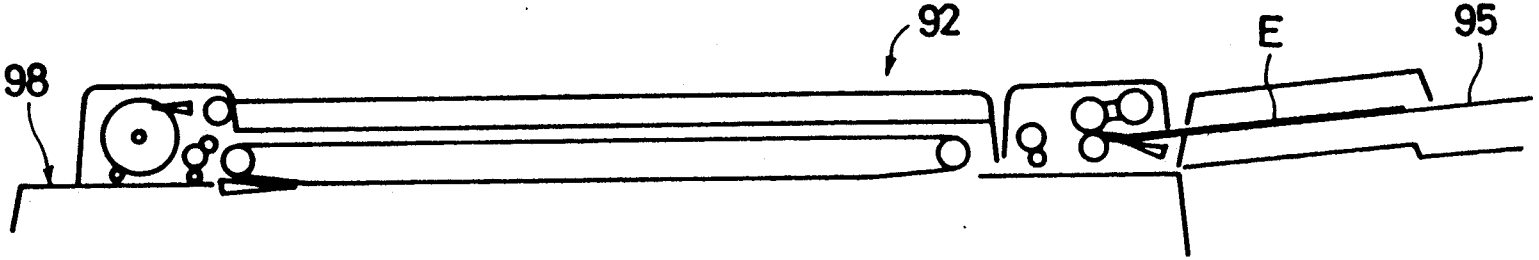
FIG. 20 PRIOR ART
FIGS. 20 through 32 are schematic longitudinal sectional views showing the prior art, which illustrate the process for transporting the document in the document feeder.
Figure 21:
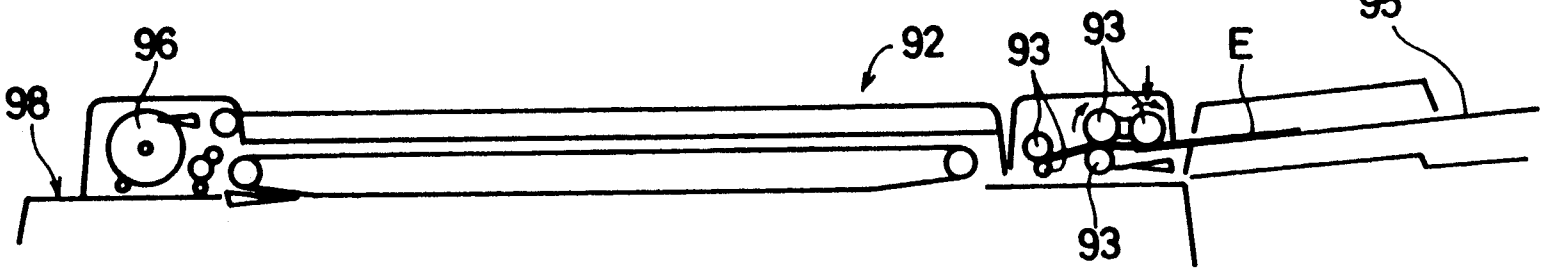
FIG. 21 PRIOR ART
Figure 22:
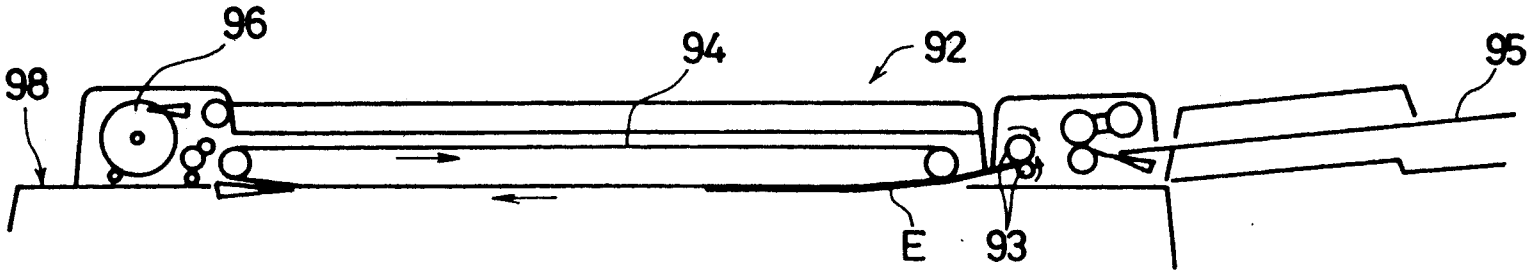
FIG. 22 PRIOR ART
Figure 23:
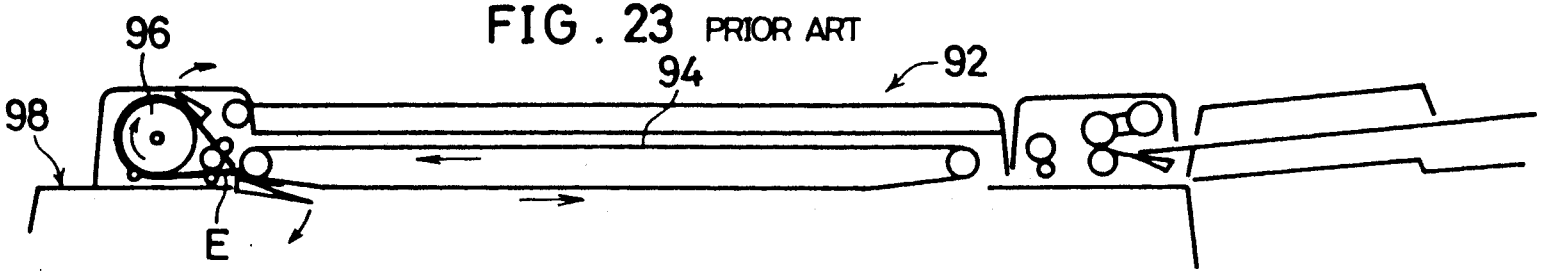
FIG. 23 PRIOR ART
Figure 24:
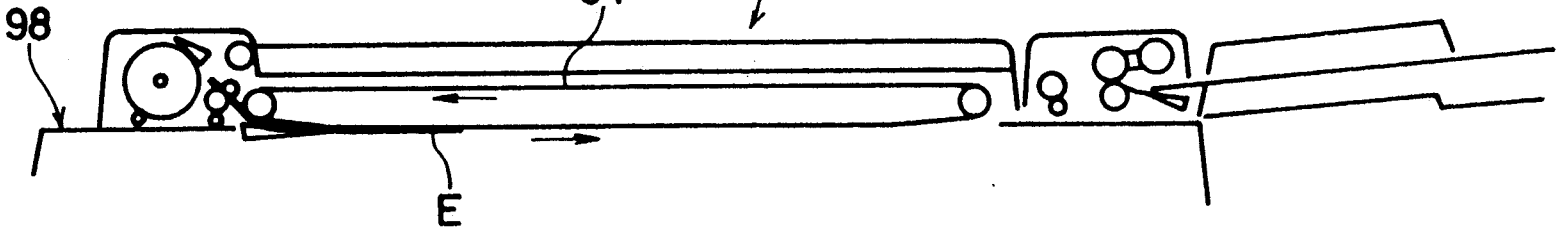
FIG. 24 PRIOR ART
Figure 25:
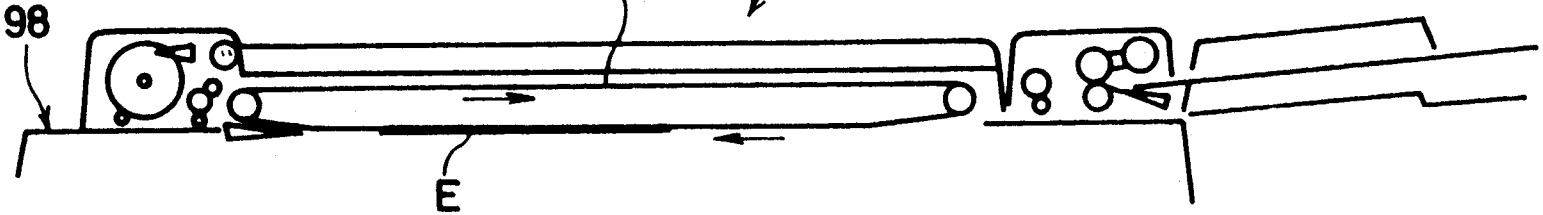
FIG. 25 PRIOR ART
Figure 26:
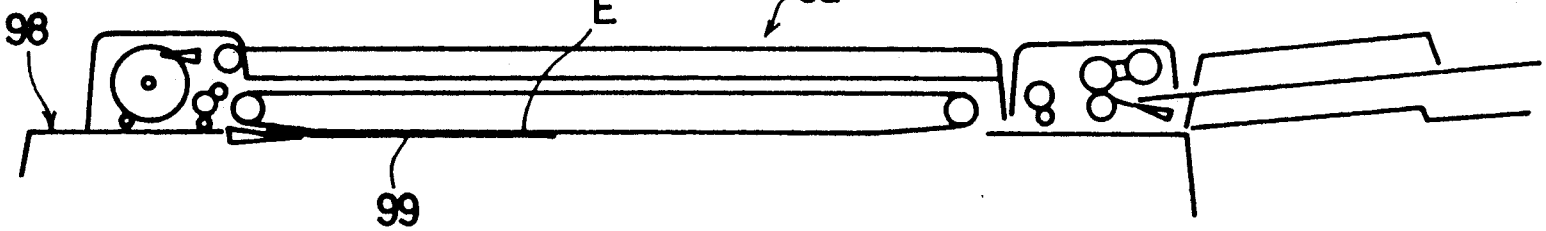
FIG. 26 PRIOR ART
Figure 27:
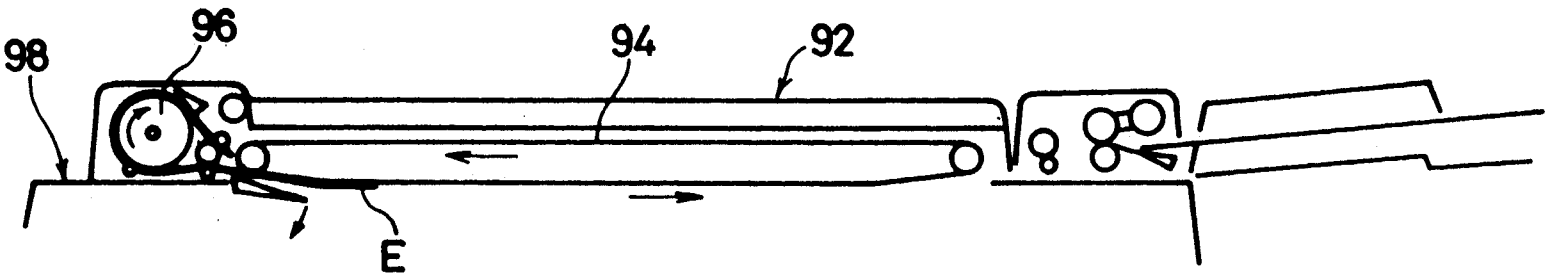
FIG. 27 PRIOR ART
Figure 28:
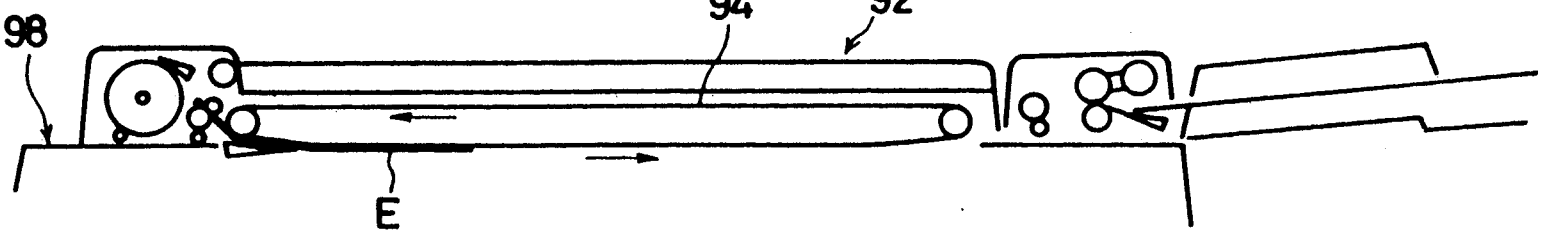
FIG. 28 PRIOR ART
Figure 29:
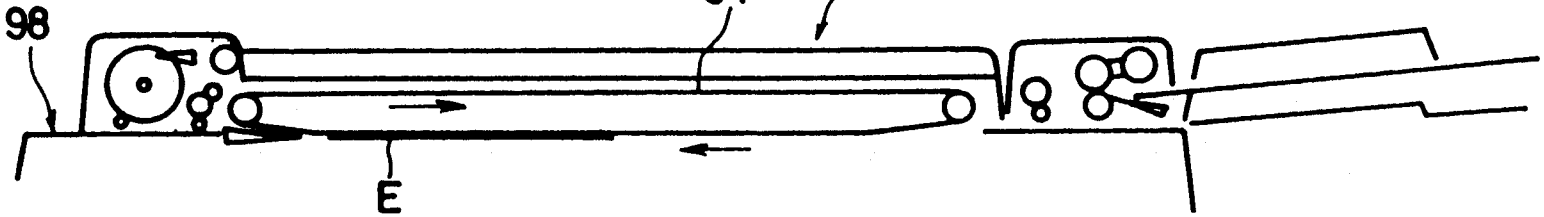
FIG. 29 PRIOR ART
Figure 30:
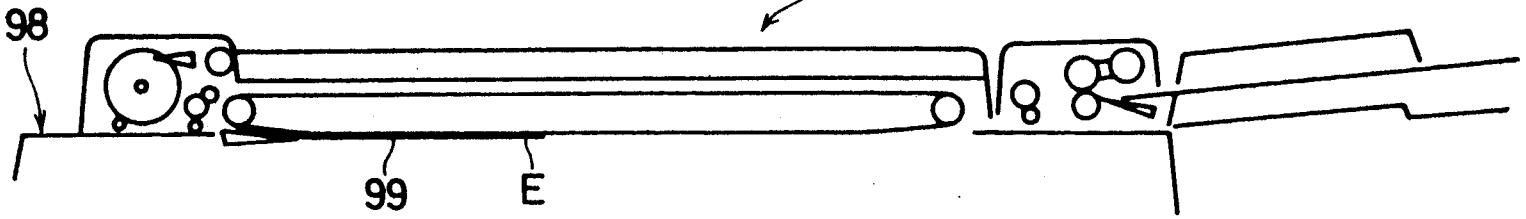
FIG. 30 PRIOR ART
Figure 31:
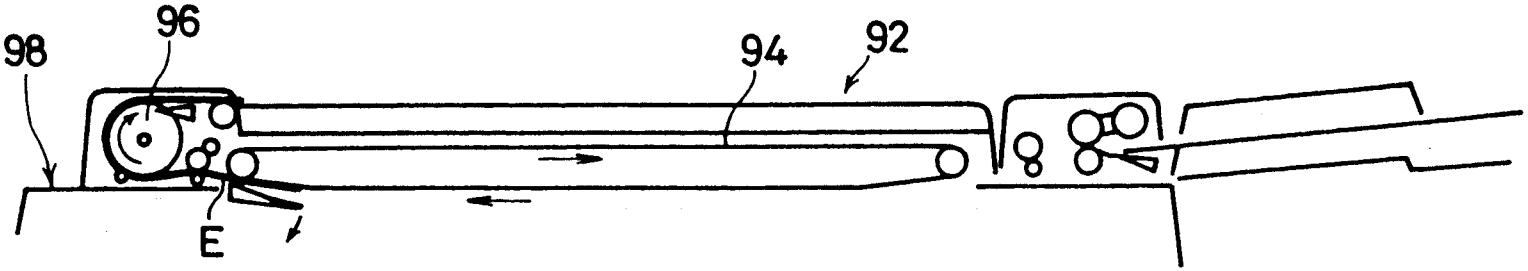
FIG. 31 PRIOR ART
Figure 32:
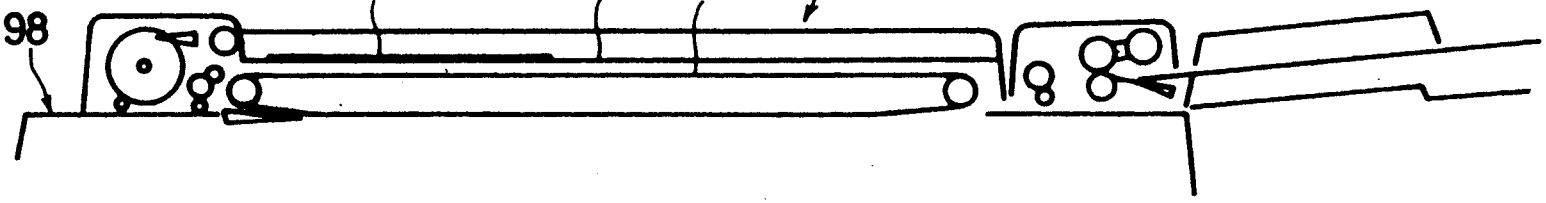
FIG. 32 PRIOR ART

Referring to FIG. 19, the following description will discuss still another example of the document feeder 45 of the present invention. Here, those of the members having the foregoing embodiments are indicated by the same reference numerals and the description thereof is omitted.

The document feeder of the present embodiment is designed so that name cards, post cards, etc., which are thicker documents, can be handled therein. As shown in FIG. 19, on the left side of the document support drum 17, there are disposed a name card tray 87 and a feed roller 88 for transporting name cards from the name card tray 87 to the original glass plate 2.

Further, a document discharge tray 9a for name cards and post cards is disposed at the downstream section from paired transport rollers 89a and 89b, and the direction to reach the document discharge tray 9a is to be selected by a branch selecting section 91.

Here, explanation will be given of the two-sided scanning operation of name cards as an example of scanning name cards, post cards, etc.

First, one of the name cards having, for example, Japanese writing on one side and English writing on the other, is fed to the exposure point P by the feed roller 88 from the name card tray 87, with the Japanese-side down, that is, facing the exposure point P.

The name card, after having been scanned at the exposure point P with respect to the Japanese-side, is transported by the document support drum 17 to the paired rollers 89a and 89b by way of a branch selecting section 90.

The name card having reached the paired rollers 89a and 89b, is discharged onto the document discharge tray 9a after being sent by the branch selecting section 91 in the direction to which the document discharge tray 9a is disposed.

This name card that has been discharged, is turned over and again set onto the name card tray 87, and the English-side of the name card is scanned in the same manner as described above.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A document feeder for feeding documents to a document scanning section where an image of each document is scanned, comprising:

first fed means for feeding the document to the document scanning section;

transport means for transporting the document from the scanning section to a transport path;

reversing means for turning over the document transported by said transport means;

second feed means for feeding to the document scanning section the document that has been turned over by said reversing means; and length adjusting means for adjusting a length of an actual document transport course of said transport path depending on the size of the document.

said length adjusting means being comprised of a reversing guide member forming an outer wall of said transport path and a pivotal shaft secured to one end of said reversing guide member, said reversing guide member being freely rotatable on said pivotal shaft to open said transport path.

2. A document feeder for feeding documents to a document scanning section where an image of each document is scanned, comprising:

first fed means for feeding the document to the document scanning section;

a first transport roller for transporting the document from the scanning section to a transport path;

reversing means for turning over the document transported by said first transport roller;

a second transport roller for feeding to the document scanning section the document that has been turned over by said reversing means; and length adjusting means for adjusting a length of an actual document transport course of said transport path depending on the size of the document, said length adjusting means comprising reversing guide means forming an outer wall of said transport path, a motor for driving said reversing guide means forward or backward depending on the size of the document to adjust the length of the actual document transport course of said transport path, and sensor means for detecting that a leading edge of the document has reached said second transport roller to thereafter stop rotation of said second transport roller and direct said reversing guide means forward.

3. A document feeder for feeding documents to a document scanning section where an image of each document is scanned, comprising:

first fed means for feeding the document to the document scanning section;

transport means for transporting the document from the scanning section to a transport path;

reversing means for turning over the document transported by said transport means;

second feed means for feeding to the document scanning section the document that has been turned over by said reversing mean; and length adjusting means for adjusting a length of an actual document transport course of said transport path depending on the size of the document, said length adjusting means comprising reversing guide means forming an outer wall of said transport path, a guide shaft to which said reversing guide means is slidably coupled, a wire secured to said reversing guide means, and pulleys, around which said wire is engaged, for moving said reversing guide means along said guide shaft by driving said wire.

4. A document feeder for feeding documents to a document scanning section where an image of each document is scanned, comprising:

first fed means for feeding the document to the document scanning section;

a first transport roller for transporting the document from the scanning section to a transport path;

reversing means for turning over the document transported by said first transport roller;

a second transport roller for feeding to the document scanning section the document that has been turned over by said reversing means; and length adjusting means for adjusting a length of an actual document transport course of said transport path depending on the size of the document, said length adjusting means comprising reversing guide means forming an outer wall of said transport path, a motor for driving said reversing guide means forward or backward depending on the size of the document to adjust the length of the actual document transport course of said transport path, and sensor means for detecting that a leading edge of the document has not reached said first transport roller when a leading edge of the document has reached said second transport roller to thereafter stop rotation of said second transport roller and direct said motor to drive said reversing guide means forward at a speed faster than half a speed at which said first transport roller transports the document to said transport path.

5. The document feeder as set forth in claim 4, wherein said sensor means further detects when the rear edge of the document passes through said first transport roller to thereafter start rotation of said second transport roller and direct said motor to drive said reversing guide member backward at a speed slower than half a speed at which the document is transported.

* * * * *